US008827404B2

(12) United States Patent
Itogawa

(10) Patent No.: US 8,827,404 B2
(45) Date of Patent: Sep. 9, 2014

(54) LIQUID EJECTING APPARATUS, METHOD FOR CONTROLLING LIQUID EJECTING APPARATUS, INSTRUCTIONS FOR LIQUID EJECTING APPARATUS

(71) Applicant: Brother Kogyo Kabushiki Kaisha, Nagoya (JP)

(72) Inventor: Yoshihiro Itogawa, Mizuho (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/065,717

(22) Filed: Oct. 29, 2013

(65) Prior Publication Data

US 2014/0184681 A1 Jul. 3, 2014

(30) Foreign Application Priority Data

Dec. 28, 2012 (JP) ..... 2012-288566

(51) Int. Cl.
*B41J 29/38* (2006.01)

(52) U.S. Cl.
USPC ..... 347/14; 347/35

(58) Field of Classification Search
CPC ..... B41J 29/17; B41J 2/04598; B41J 2/165; B41J 2/04596; B41J 2/1652
USPC ..... 347/14, 22, 23, 35, 37, 60
See application file for complete search history.

(56) References Cited

U.S. PATENT DOCUMENTS 6,070,959 A * 6/2000 Kanbayashi et al. ..... 347/11
2012/0019872 A1 1/2012 Kanno

FOREIGN PATENT DOCUMENTS

JP 2006-168209 A 6/2006
JP 2012-011580 A 1/2012
JP 2012-025005 A 2/2012

* cited by examiner

*Primary Examiner* — Thinh Nguyen
(74) *Attorney, Agent, or Firm* — Banner & Witcoff, Ltd.

(57) ABSTRACT

A liquid ejecting apparatus includes: a plurality of liquid ejecting heads configured to eject liquids of a plurality of colors respectively from a plurality of ejection nozzles; an image data storage device configured to store image data with respect to an image to be recorded on a recording medium; a mode receiving device which receives one image quality mode from at least two image quality modes including a low image quality mode and a high image quality mode, as an image quality mode with respect to an image quality of the image; a control device configured to control the plurality of ejecting heads and generate a plurality of preliminary ejection data related to preliminary ejections for recovering ejection performances of the plurality of liquid ejecting heads for the plurality of liquid ejecting heads respectively.

10 Claims, 14 Drawing Sheets

IMAGE DOT AREA

IMAGE DOT AREA IN WHICH IMAGE DOT OF CYAN COLOR IS FORMED

FLUSHING DOT AREA IN WHICH FLUSHING DOT OF CYAN COLOR IS FORMED

IMAGE DOT AREA, AS WELL AS FLUSHING DOT AREA IN WHICH FLUSHING DOT OF CYAN COLOR IS FORMED

LIQUID EJECTING APPARATUS, METHOD FOR CONTROLLING LIQUID EJECTING APPARATUS, INSTRUCTIONS FOR LIQUID EJECTING APPARATUS

CROSS REFERENCE TO RELATED APPLICATION

The present application claims priority from Japanese Patent Application No. 2012-288566, filed on Dec. 28, 2012, the disclosure of which is incorporated herein by reference in its entirety.

BACKGROUND OF THE INVENTION

1. Field of the Invention

The present invention relates to a liquid ejecting apparatus, a method for controlling the liquid ejecting apparatus, and a storage medium storing instructions for the liquid ejecting apparatus.

2. Description of the Related Art

As a liquid ejecting apparatus for recording an image on a recording medium, an ink-jet recording apparatus, which includes an ink-jet head for ejecting an ink from ejecting ports, has been known. In this ink-jet recording apparatus, to prevent degradation of ejecting characteristics due to thickening of ink near the ejecting ports, preliminary ejecting (flushing) of ink irrespective of image recording is carried out. For instance, an ink-jet recording apparatus, in which a ejecting pattern for the preliminary ejecting is attached to image data and the preliminary ejecting is carried out on a recording medium during image recording, has been known. In the abovementioned ink-jet recording apparatus, irrespective of the content of the image data, the same ejecting pattern for the preliminary ejecting is added to the image data all the time.

SUMMARY OF THE INVENTION

Incidentally, a liquid ejecting apparatus in which it is possible to select, as an image quality mode of an image to be recorded on a recording medium, a low image quality mode and a high image quality mode of carrying out recording of an image of a quality higher than an image in the low image quality mode has been known. Here, in a case of carrying out preliminary ejecting by using the same ejecting pattern for the preliminary ejecting all the time as in the abovementioned hitherto known ink-jet recording apparatus, in the high image quality mode, there is a possibility that the image quality is degraded due to flushing dots formed by a liquid that has been ejected in the preliminary ejecting, and that the desired image cannot be achieved.

An object of the present invention is to provide a liquid ejecting apparatus which suppresses the degradation of an image due to the flushing dots, a method for controlling the liquid ejecting apparatus, and a storage medium storing instructions for the liquid ejecting apparatus.

According to a first aspect of the present invention, there is provided a liquid ejecting apparatus including: a plurality of liquid ejecting heads including a plurality of ejection nozzles and configured to eject liquids of a plurality of colors respectively from the ejection nozzles; an image data storage device configured to store image data with respect to an image to be recorded on a recording medium; a mode receiving device configured to receive one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control device configured to: control the plurality of liquid ejecting heads, based on the image data stored, to eject the liquids from the ejection nozzles of the plurality of liquid ejecting heads onto a plurality of image dot areas, among a plurality of dot areas defined on the recording medium, thereby forming image dots of the plurality of colors by the liquids landed on the plurality of image dot areas; generate a plurality of preliminary ejection data for the plurality of liquid ejecting heads respectively, the plurality of preliminary ejection data being related to preliminary ejections for recovering ejection performances of the plurality of liquid ejecting heads respectively; and control the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received by the mode receiving device, the control device is configured to generate the plurality of preliminary ejection data, so that a ratio of the number of dot areas, on each of which one of the image dots as well as one of the flushing dots is formed, to the number of the flushing dot areas is higher than the ratio in a case that the low image quality mode is received by the mode receiving device.

According to a second aspect of the present invention, there is provided a non-transitory computer-readable storage medium storing computer-executable instructions that, when executed by a processor, cause a liquid ejecting apparatus including: a plurality of liquid ejecting heads including a plurality of ejection nozzles and configured to eject liquids of a plurality of colors respectively from the ejection nozzles; and an image data storage device configured to store image data with respect to an image to be recorded on a recording medium, to perform: a mode receiving process of receiving one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control process of: controlling the plurality of liquid ejecting heads, based on the image data stored, to eject the liquids from the ejection nozzles of the plurality of liquid ejecting heads onto a plurality of image dot areas, among a plurality of dot areas defined on the recording medium, thereby forming image dots of the plurality of colors by the liquids landed on the plurality of image dot areas; generating a plurality of preliminary ejection data for the plurality of liquid ejecting heads respectively, the plurality of preliminary ejection data being related to preliminary ejections for recovering ejection performances of the plurality of liquid ejecting heads respectively; and controlling the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received in the mode receiving process, in the control process, the plurality of preliminary ejection data is generated so that a ratio of the number of dot areas, on each of which one of the image dots as well as one of the flushing dots is formed, to the number of the flushing dot areas is higher than the ratio in a case that the low image quality mode is received in the mode receiving process.

According to a third aspect of the present invention, there is provided a control method for controlling a liquid ejecting apparatus including: a plurality of liquid ejecting heads including a plurality of ejection nozzles and configured to eject liquids of a plurality of colors respectively from the ejection nozzles; and an image data storage device configured to store image data with respect to an image to be recorded on a recording medium, the method including: a mode receiving process of receiving one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control process of: controlling the plurality of liquid ejecting heads, based on the image data stored, to eject the liquids from the ejection nozzles of the plurality of liquid ejecting heads onto a plurality of image dot areas, among a plurality of dot areas defined on the recording medium, thereby forming image dots of the plurality of colors by the liquid landed on the plurality of image dot areas; generating a plurality of preliminary ejection data for the plurality of liquid ejecting heads respectively, the plurality of preliminary ejection data being related to preliminary ejections for recovering ejection performances of the plurality of liquid ejecting heads respectively; and controlling the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received in the mode receiving process, in the control process, the plurality of preliminary ejection data is generated so that a ratio of the number of dot areas, on each of which one of the image dots as well as one of the flushing dots is formed, to the number of the flushing dot areas is higher than the ratio in a case that the low image quality mode is received in the mode receiving process.

As the quality of the image to be recorded on the recording medium becomes high, visibility of the flushing dots formed in dot areas on which the image dots are formed becomes lower than visibility of the flushing dots formed in dot areas on which the image dots are not formed. Accordingly, it is possible to suppress degradation of the image due to the flushing dots by making an arrangement such that, in the high image quality mode, a ratio of the number of dot areas on the recording medium formed by the flushing dots being overlapped with the image dots to the number of all the dot areas on the recording medium on which the flushing dots are formed is higher than the ratio in the low image quality mode.

DETAILED DESCRIPTION OF THE PREFERRED EMBODIMENTS

Figure 1:
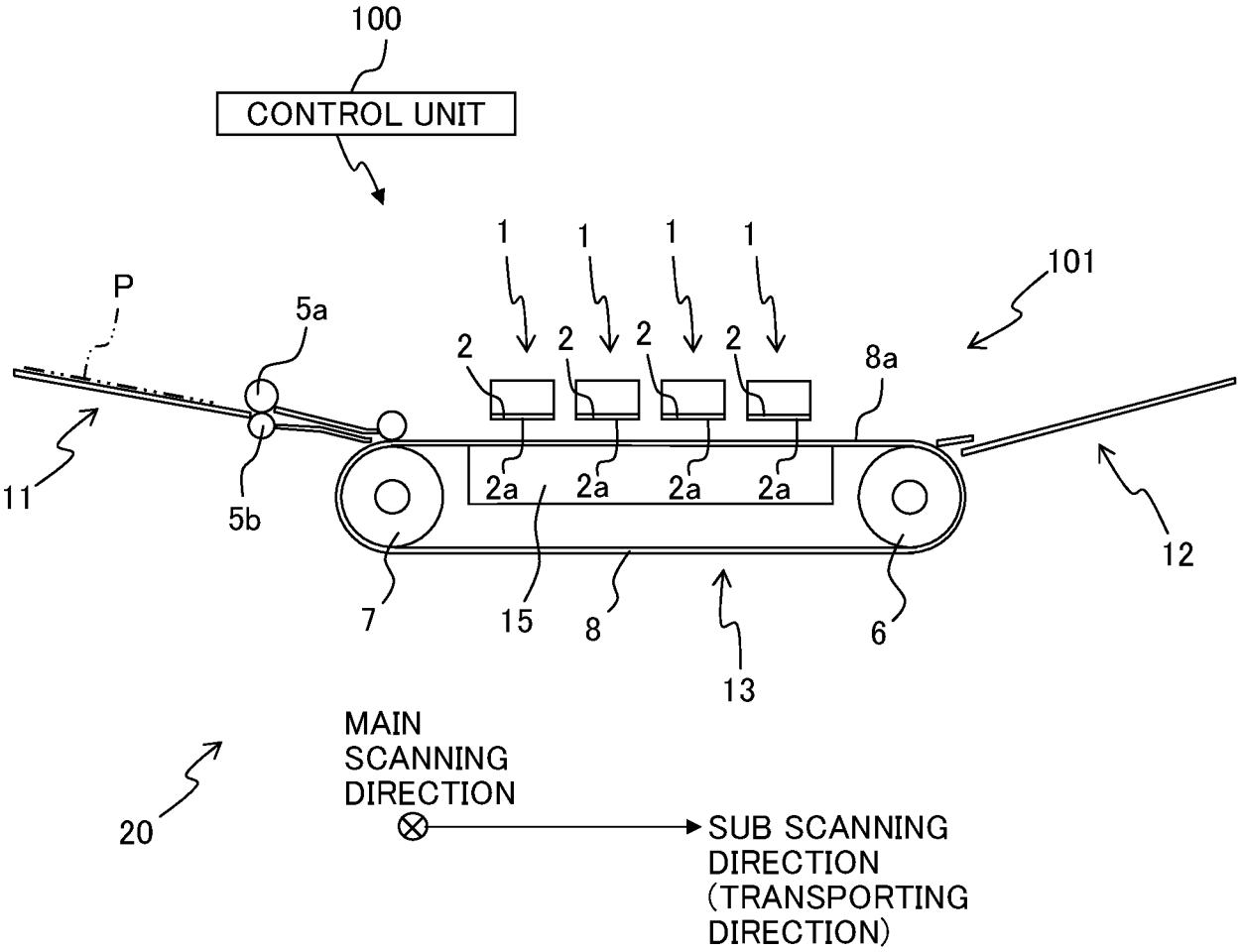
FIG. 1 is a schematic side view of an ink-jet printer according to an embodiment of the present invention.

An ink-jet printer to which a liquid ejecting apparatus has been applied will be described below as an exemplary embodiment of the present invention while referring to the accompanying diagrams. As shown in FIG. 1, an ink-jet printer 101 (hereinafter, "printer 101") includes a transporting mechanism 20 which transports a paper P which is a recording medium, four ink-jet heads 1 (hereinafter, "heads 1") which jet inks of magenta, cyan, yellow, and black colors respectively toward the paper P transported by the transporting mechanism 20, a touch panel 60 (refer to FIG. 4, an example of a mode receiving device), and a control unit 100 which controls an operation of the printer 101. Moreover, the printer 101 according to the embodiment has two modes, namely a low image quality mode and a high image quality mode of carrying out recording of an image having a quality superior to an image quality achieved by the low image quality mode, as an image quality mode related to the quality of an image to be recorded on the paper P.

The transporting mechanism 20 defines a transporting path through which the paper P is transported from a paper feeding tray 11 toward a paper discharge tray 12, and the transporting mechanism 20 includes a pair of feeding rollers 5*a* and 5*b*, and a belt transporting unit 13. The pair of feeding rollers 5*a* and 5*b* is arranged at an immediate downstream of the paper feeding tray 11, and feeds the paper P rightward in the diagram from the paper feeding tray 11. The paper P fed by the pair of feeding rollers 5*a* and 5*b* is supplied to the belt transporting unit 13. The belt transporting unit 13 includes two belt rollers 6 and 7, a transporting belt 8 which is endless and is put around the two belt rollers 6 and 7, and a platen 15 which is positioned to face the four heads 1 in an area surrounded by the transporting belt 8. By rotating the belt roller 6 in a clockwise direction with a motor driver 38 (refer to FIG. 4), the transporting belt 8 is turned in the clockwise direction. Accordingly, the transporting belt 8 transports the paper P toward the paper discharge tray 12, while holding the paper P that has been pressed against an adhesive outer peripheral surface of the transporting belt 8.

The four heads 1 eject the inks of mutually different colors (magenta, yellow, cyan, and black). The four heads 1 have a substantially rectangular parallelepiped shape, with a longer side in a main scanning direction. Moreover, the four heads 1 are arranged and fixed along a transporting direction of the paper P. In other words, the printer 101 is a line printer. Each of the four heads 1 has a head main-body 2 at a lower end thereof. The head main-body 2 has a rectangular parallelepiped shape with a longer side in a direction orthogonal to the transporting direction. A bottom surface of the head main-body 2 is a ejecting surface 2*a* that is facing a transporting surface 8*a* which is positioned at an upper side of the outer peripheral surface of the transporting belt 8. When the paper P transported by the transporting belt 8 passes areas facing the ejecting surfaces 2*a* of the four head main-bodies 2 in order, ink droplets of each color are ejected from the ejecting surface 2*a* toward an upper surface, or in other words, toward a printing surface of the paper P. Accordingly, a desired color image is formed on the paper P. In the embodiment, the head 1 corresponds to a liquid ejecting head of the present invention. Moreover, the printer 1 has ink tanks (not shown in the diagrams) in which inks of mutually different colors are stored. The ink is supplied from each of the ink tanks to the corresponding head 1 via a tube.

Figure 2:
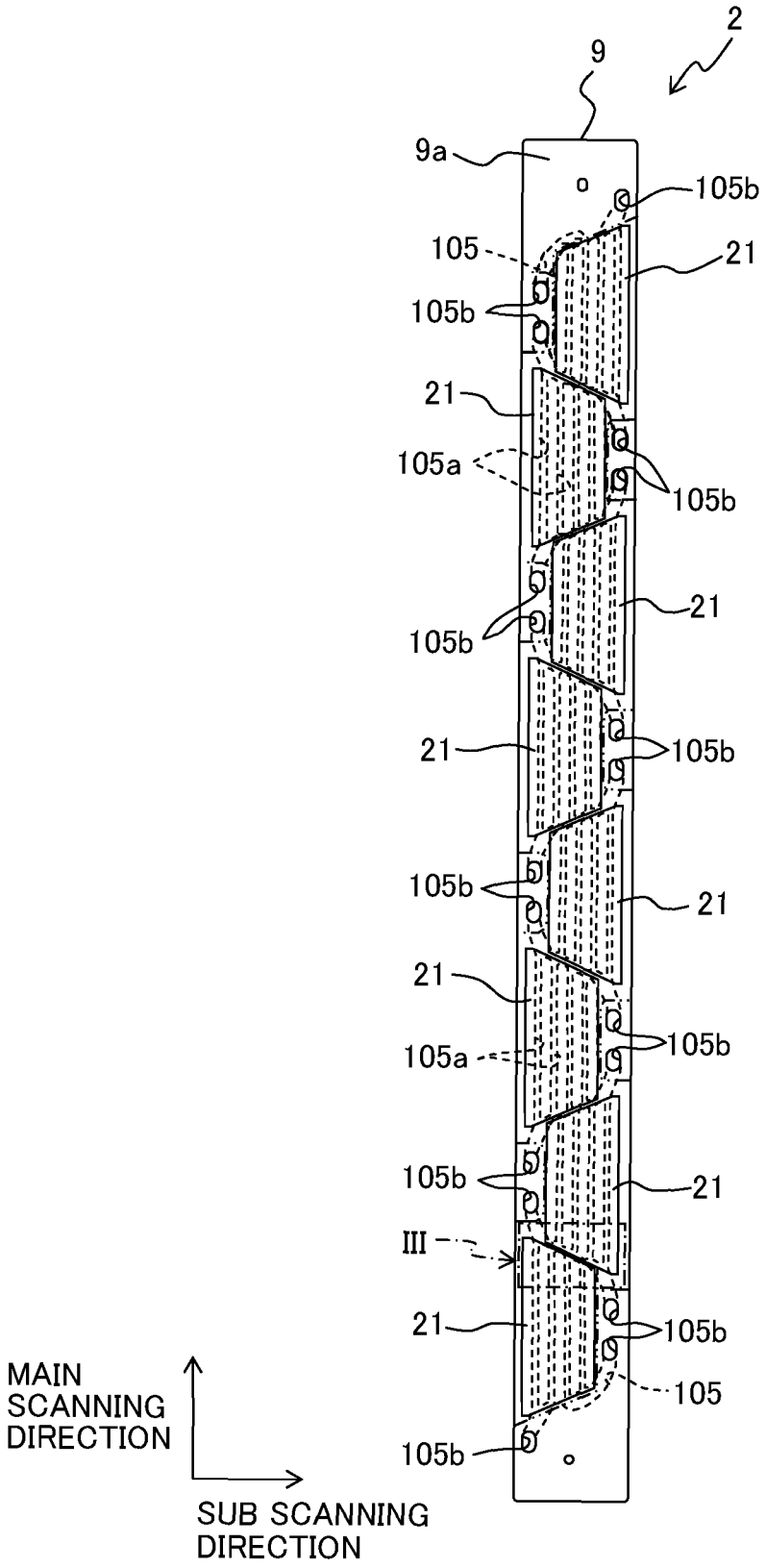
FIG. 2 is a plan view of an ink-jet head in FIG. 1.
Figure 3A:
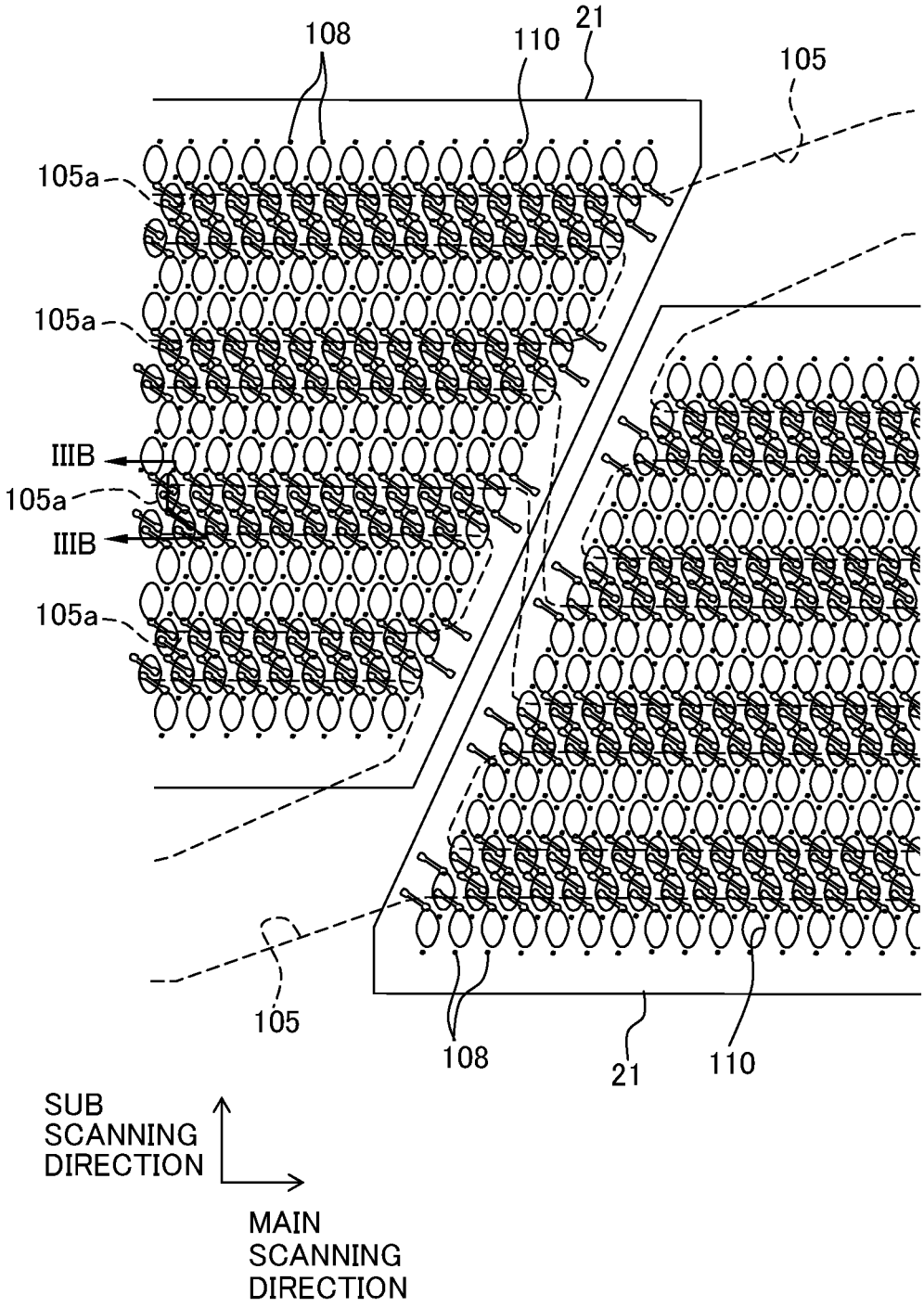
FIG. 3A is an enlarged view showing an area III surrounded by alternate long and short dash line in FIG. 2.
Figure 3B:
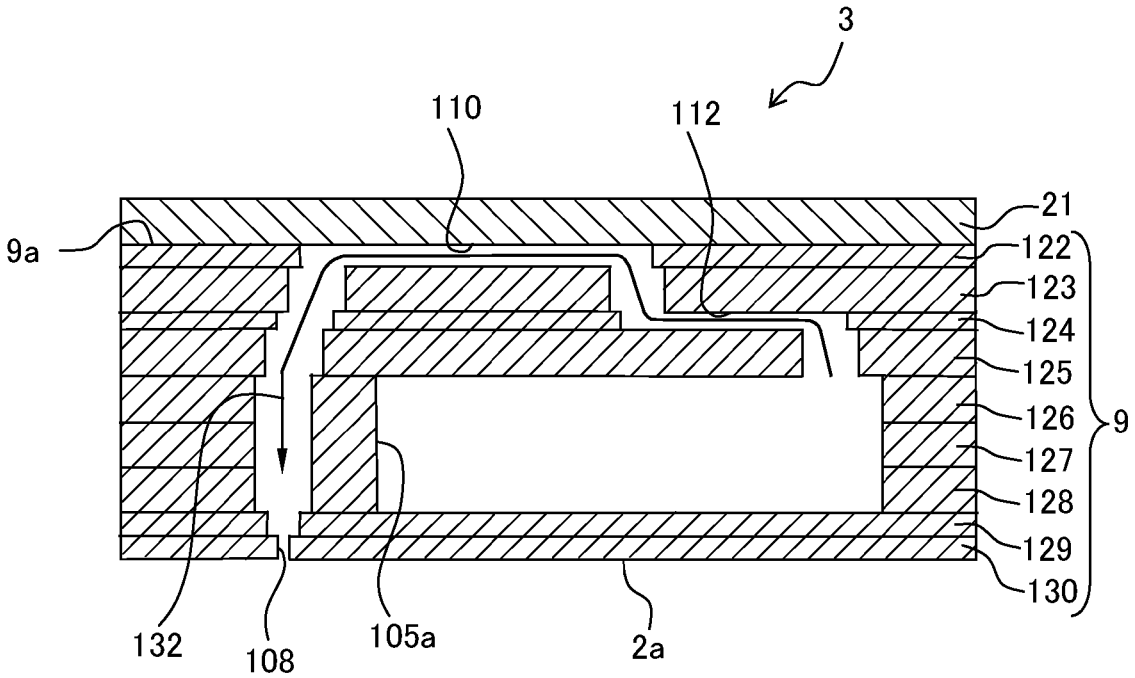
FIG. 3B is a partial cross-sectional view along a line IIIB-IIIB in FIG. 3A.

Next, the head main-body 2 of the head 1 will be described below while referring to FIG. 2, FIG. 3A and FIG. 3B. In FIG. 3A, for the sake of explanation, pressure chambers 110 and ejecting ports 108 (an example of ejection nozzles) to be drawn by dashed lines, which are at a lower side of an actuator unit 21, are drawn by solid lines. As shown in FIG. 2, the head main-body 2 includes a channel unit 9, eight actuator units 21 which are fixed to an upper surface 9*a* of the channel unit 9, and a reservoir unit (not shown in the diagram). A common liquid channel which includes a reservoir that stores the ink temporarily is formed in the reservoir unit, and the ink is supplied from the cartridge to the reservoir unit. The actuator unit 21 includes a plurality of individual electrodes provided to face the plurality of pressure chambers 110 that are formed in the channel unit 9, and has a function of imparting selectively a ejecting energy to the ink in the pressure chamber 110.

The channel unit 9 is a stacked structure in which nine rectangular-shaped metal plates 122, 123, 124, 125, 126, 127, 128, 129, and 130 (hereinafter, "metal plates 122 to 130") (refer to FIG. 3B) are stacked. Ink supply ports 105*b* connected to the reservoir unit open in the upper surface 9*a* of the channel unit 9. At an interior of the channel unit 9, a plurality of manifold channels 105 each of which has one of the ink supply ports 105*b* as one end thereof, a plurality of sub-manifold channels 105*a* branched from each of the manifold channels 105, and a plurality of individual ink channels 132 connected to each of the sub-manifold channels 105*a* are formed. Each of the individual ink channels 132 includes an aperture 112 for adjusting a channel resistance and extends from an outlet of one of the sub-manifold channels 105*a* to one of a plurality of ejecting ports 108 via one of a plurality of pressure chambers 110. The plurality of pressure chambers 110 are arranged in a form of matrix on the upper surface 9*a* of the channel unit 9. On the other hand, the ejecting ports 108 are arranged in the form of matrix, or in other words, are arranged two-dimensionally and regularly, corresponding to the pressure chambers 110. The ejecting ports 108 are aligned in the main scanning direction at an interval such that a recording resolution in the main scanning direction becomes 600 dpi (dots per inch).

Next, the actuator unit 21 will be described below. The actuator unit 21 includes a plurality of actuators facing the pressure chambers 110 respectively. Each of the actuators imparts selectively the ejecting energy for each ejecting cycle (printing cycle) to the ink in one of the pressure chambers 110. Concretely, the actuator unit 21 includes three piezoelectric sheets made of a ceramics material of lead zirconium titanate (PZT) which is ferroelectric. Each piezoelectric sheet is a continuous flat plate having a size spread over the plurality of pressure chambers 110. Individual electrodes are formed at a position facing the pressure chambers 110 respectively on the piezoelectric sheet at the uppermost layer. A common electrode is interposed over the entire sheet surface, between the piezoelectric sheet of the uppermost layer and the piezoelectric sheet on a lower side.

The common electrode is kept at a ground electric potential which is same in areas corresponding to all the pressure chambers. On the other hand, a signal, which is obtained by letting a drive signal from a head driving circuit 37 (refer to FIG. 4) of the control unit 100 to undergo level conversion by a driver IC (not shown in the diagram), is inputted selectively to each of the individual electrode. In such manner, in the actuator unit 21, portions sandwiched between the individual electrodes and the common electrode function as individual actuators. In such manner, the plurality of actuators, same as the number of the pressure chambers 110, are arranged in the actuator unit 21.

Here, a method of driving the actuator unit 21 will be described. The actuator unit 21 is an actuator of a so-called unimorph type in which one piezoelectric sheet which is farthest from the pressure chambers 110 is let to be an active layer, and the remaining two piezoelectric sheets are let to be inactive layers. By outputting a pulse to one of the individual electrodes, a part of the piezoelectric sheet corresponding to the individual electrode to which the pulse has been outputted is deformed, and a pressure is applied (ejecting energy is imparted) to the ink in the pressure chamber 110 corresponding to the individual electrode, and ink droplets are ejected from the ejecting port 108 corresponding to the individual electrode.

Figure 4:
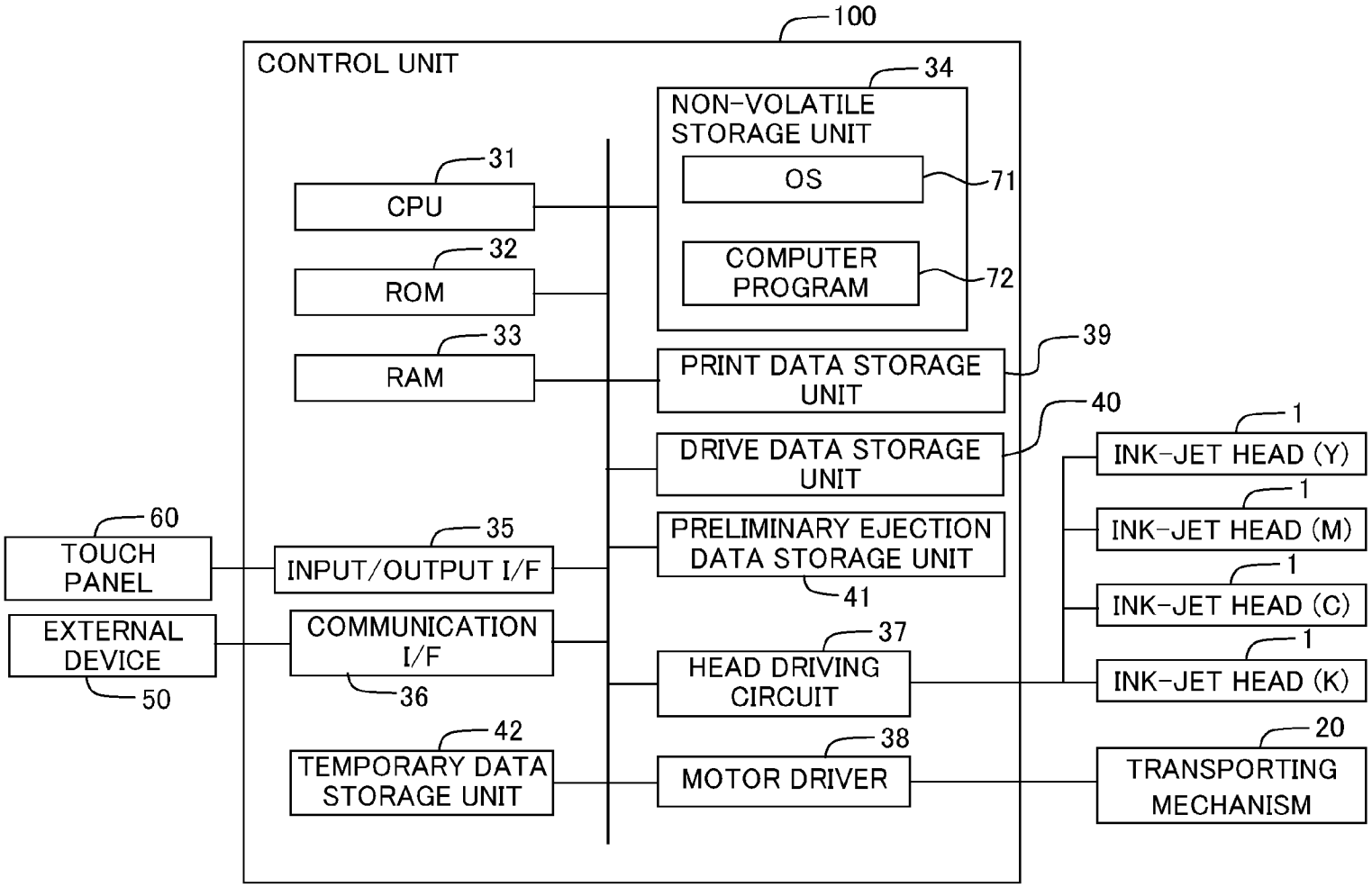
FIG. 4 is an electrical block diagram of the ink-jet printer in FIG. 1.

Next, the control unit 100 will be described below. The control unit 100 controls an image recording operation based on a recording command (including print data and print conditions) supplied from an external device 50 (such as a PC (personal computer) connected to the printer 101). As shown in FIG. 4, the control unit 100 includes a CPU (central processing unit) 31 (an example of a control device) which executes various computer programs, a ROM (read only memory) 32 which stores the computer programs, a RAM (random access memory) 33 which is to be used as a work area at the time of executing a computer program, a non-volatile storage unit 34, an input/output interface 35, a communication interface 36 (an example of a mode receiving device), the head driving circuit 37, the motor driver 38, a print data storage unit 39, a drive data storage unit (image data storage device) 40, a preliminary ejection data storage unit 41, and a temporary data storage unit 42. The print data storage unit 39, the drive data storage unit 40, the preliminary ejection data storage unit 41, and the temporary data storage unit 42 are realized by a flash memory, a RAM and the like.

The non-volatile storage unit 34 is realized by a HDD (hard disc drive) and the like, and has an operating system (OS) 71 and various control programs 72 stored therein. The input/output interface 35 is an interface for connecting data-communicably with the touch panel 60. Moreover, the communication interface 36 is an interface for connecting data-communicably with the external device 50. The head driving circuit 37 is a circuit for driving each actuator in the actuator unit 21 provided in each head 1. The motor driver 38 is provided for driving the transporting mechanism 20.

Print data (data described in PDL (page description language)) included in the recording command which has been transmitted from the external device 50 is stored in the print data storage unit 39.

Drive data created by a drive data creating section 145 is stored in the drive data storage unit 40. The drive data is drive data of each actuator included in the actuator unit 21 which is provided to each head 1, and is data for indicating ink ejecting amount for each color (one of four stages namely, zero, small droplets, medium droplets, and large droplets) and a dot forming position over plurality of printing cycles, with respect to each ejecting port 108. Here, the printing cycle is defined as a time required for the paper P to move by a unit distance corresponding to a recording resolution in the transporting direction, or in other words, in a sub-scanning direction with respect to the heads 1. Moreover, in the embodiment, in a case that a high image quality mode is selected as an image quality mode, the recording resolution (1200 dpi) of the drive data created by the drive data creating section 145 with respect to the sub-scanning direction is higher than the recording resolution (600 dpi) of the drive data created by the drive data creating section 145 with respect to the sub-scanning direction when a low image quality mode is selected. Accordingly, in the high image quality mode, an amount of ink being ejected from the ejecting port 108 of the head 1 and landing on a unit area of the paper P becomes larger than an amount of ink landing in the low image quality mode.

Predetermined preliminary ejection data to be used when the low image quality mode is selected as the image quality mode is stored in the preliminary ejection data storage unit 41. The preliminary ejection data is data which is to be used at the time of carrying out preliminary ejection in which thickened inks near the ejecting ports 108 are ejected toward the paper P for recovering ejecting characteristics of the head 1. More elaborately, the preliminary ejection data is data in which flushing dot areas, in a plurality of dot areas defined on the paper P, are specified. Here, the plurality of dot areas are areas on the paper P defined by demarcating by a distance corresponding to a recording resolution in the main scanning direction (a direction orthogonal to the transporting direction) and a distance corresponding to a recording resolution in the sub-scanning direction (transporting direction). Since the recording resolution with respect to the sub-scanning direction when the image quality mode is a high image quality mode is higher than the recording resolution with respect to the sub-scanning direction when the image quality mode is a low image quality mode, the number of dot areas defined on the paper P in the high image quality mode is larger than the number of dot areas defined on the paper P in the low image quality mode. Moreover, the flushing dot area is an area on which the flushing dot is formed on the paper P by landing of the ink ejected from one of the ejecting ports 108 by the preliminary ejection.

Figure 5:
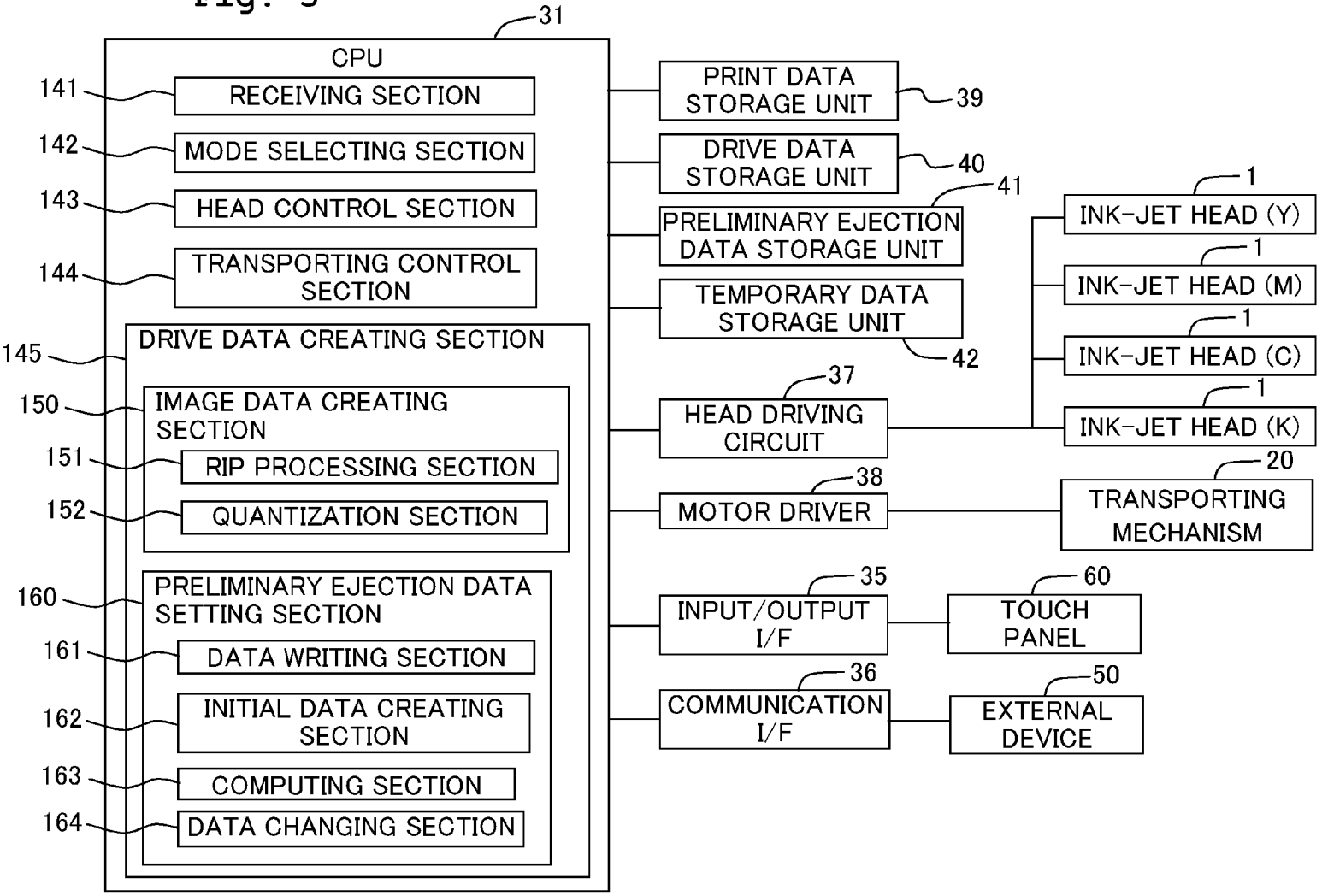
FIG. 5 is a functional block diagram of the ink-jet printer in FIG. 1.

Next, the CPU 31 of the control unit 10 will be described below in detail while referring to FIG. 5. The CPU 31, by activating the control program 72 under the control of the OS 71, functions as a receiving section 141, a mode selecting section 142, a head control section 143, a transporting control section 144, and a drive data creating section 145.

The receiving section 141 receives a recording command transmitted from the external device 50 via the communication interface 36, and stores print data included in the recording command received in the print data storage unit 39.

The mode selecting section 142 selects one of the low image quality mode and the high image quality mode as the image quality mode with respect to the quality of image to be recorded on the paper P. Concretely, the mode selecting section 142 selects the image quality mode based on print conditions included in the recording command received by the receiving section 141. As a modified example, the mode selecting section 142 may display on the touch panel 60 an image quality mode selection screen by controlling the input/output interface 35, and thereafter, may select the image quality mode selected by a user via the touch panel 60 as the image quality mode of the image to be recorded on the paper P.

The head control section 143 forms image dots of four colors and flushing dots of four colors on the paper P, by driving each actuator in the actuator unit 21 provided to each head 1 via the head driving circuit 37 based on the drive data stored in the drive data storage unit 40 to eject the ink from each ejecting port 108 of the head 1. In a case of any of the low image quality mode and the high image quality mode being selected as the image quality mode by the mode selecting section 142, the head control section 143 controls the head driving circuit 37 such that a ejecting frequency of ejecting the ink from each of the ejecting ports 108 of the head 1 becomes same.

The transporting control section 144 controls the transporting mechanism 20 via the motor driver 38 such that the paper P passes between the heads 1 and the transporting belt 8 with a predetermined transporting velocity. Concretely, the transporting control section 144 controls the transporting velocity of the paper P such that the ink ejected from the ejecting port 108 of the head 1 lands on the paper P at an interval corresponding to the recording resolution in the sub-scanning direction. Since the recording resolution with respect to the sub-scanning direction of the high image quality mode is higher than the recording resolution with respect to the sub-scanning direction of the low image quality mode, the transporting velocity (hereinafter, "low transporting velocity") in the high image quality mode becomes slower than the transporting velocity (hereinafter, "high transporting velocity") in the low image quality mode.

The drive data creating section 145 includes an image data creating section 150 and a preliminary ejection data setting section 160, and creates drive data for driving each actuator in the actuator unit 21 provided to each head 1, and stores the drive data created in the drive data storage unit 40.

The image data creating section 150 includes an RIP (raster image processor) processing section 151 and a quantization section 152, and creates image data based on the print data stored in the print data storage unit 39. The image data is image dot data indicating a gradation value corresponding to an amount of ink of each color that lands on each of the plurality of dot areas defined on the paper P.

The RIP processing section 151 carries out a heretofore known RIP (Raster Image Processor) processing on the print data stored in the print data storage unit 39, to create raster data expressed by a CMYK (cyan, magenta, yellow, black) color model. Dot data included in the raster data is associated with the plurality of dot areas respectively on the paper P, and has gradation values of cyan, magenta, yellow, and black colors expressed by the numbers 0 to 255 respectively.

The quantization section 152 creates image data from each dot data of the raster data created by the RIP processing section 151 by using error diffusion method. Concretely, the quantization section 152 divides gradation information of the dot data included in the raster data into four groups by using threshold values of three types, namely large, medium, and small. And then, the quantization section 152 creates image data indicating whether the ink is to be landed for each color of the ink in each dot area. In a case that the ink is to be landed, the quantization section 152 creates image data indicating an amount of ink (large droplets, medium droplets, or small droplets). Moreover, the quantization section 152 calculates an error in the gradation value of the raster data and the gradation value corresponding to the amount of ink in the image data, for each image dot data, and distributes the error to the image dot data corresponding to a dot area around the dot area corresponding to that image dot data. Moreover, the quantization section 152 writes the image data created, in the drive data storage unit 40. Accordingly, the inks, which have been ejected from the ejecting ports 108 of each head 1 based on the image data stored in the drive data storage unit 40, land on the plurality of dot areas defined on the paper P, and image dots corresponding to each ink color are formed.

The preliminary ejection data setting section 160 includes a data writing section 161, an initial data creating section 162, a computing section 163, and a data changing section 164, and sets preliminary ejection data related to preliminary ejection of the head 1.

Figure 6A:
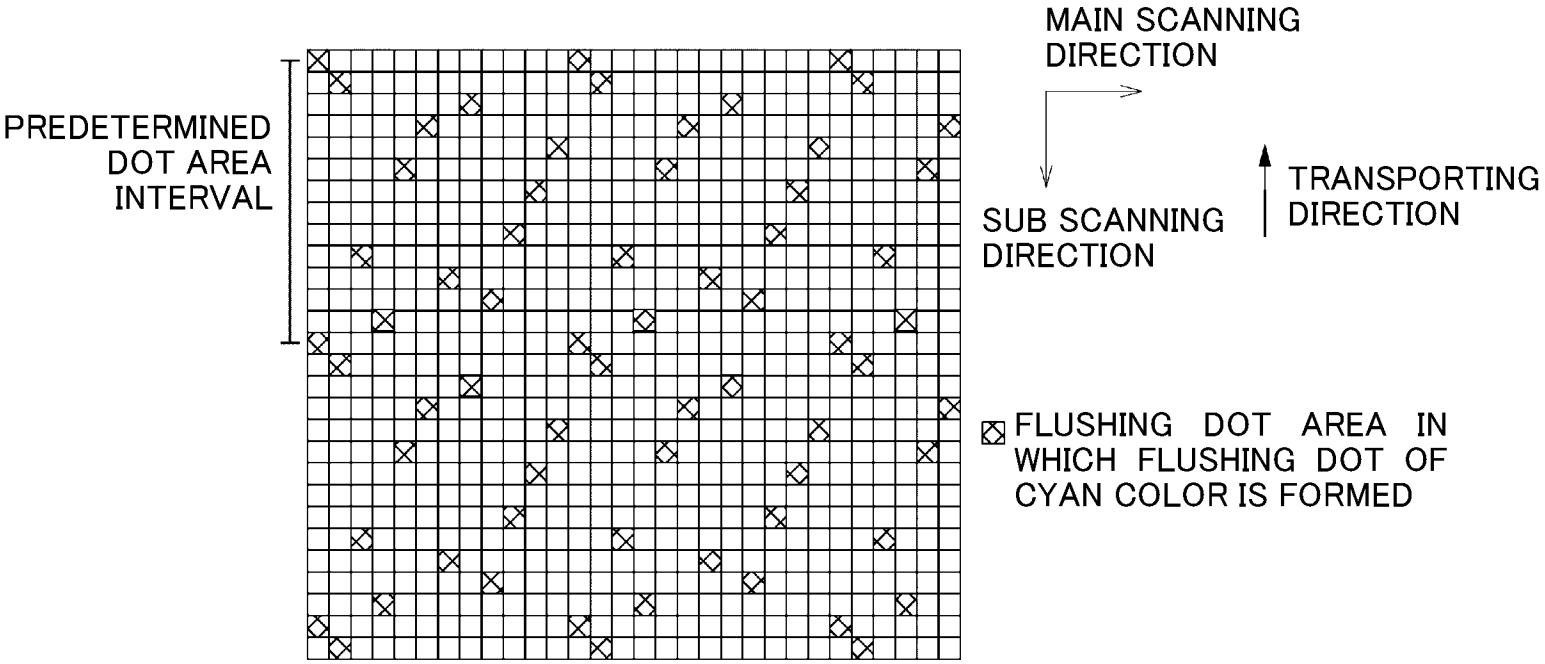
FIG. 6A, FIG. 6B, and FIG. 6C are diagrams explaining creating of drive data in a low image quality mode in a drive data creating section shown in FIG. 5.
Figure 6B:
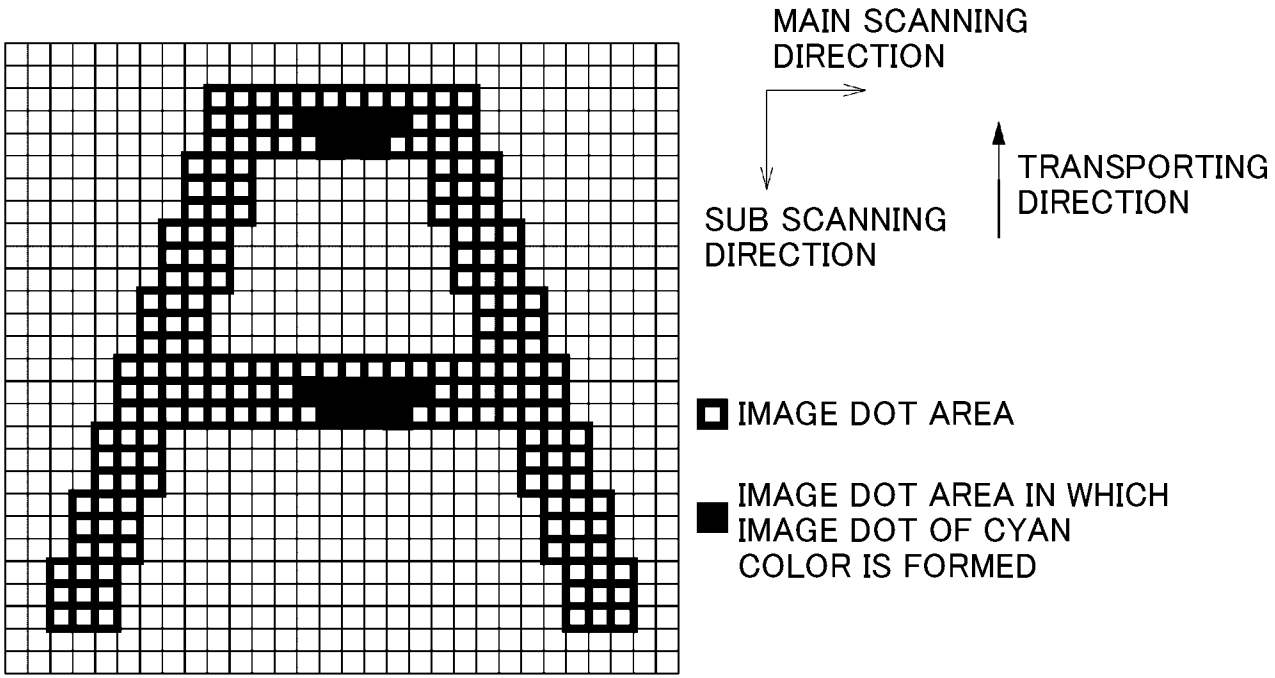
Figure 6C:
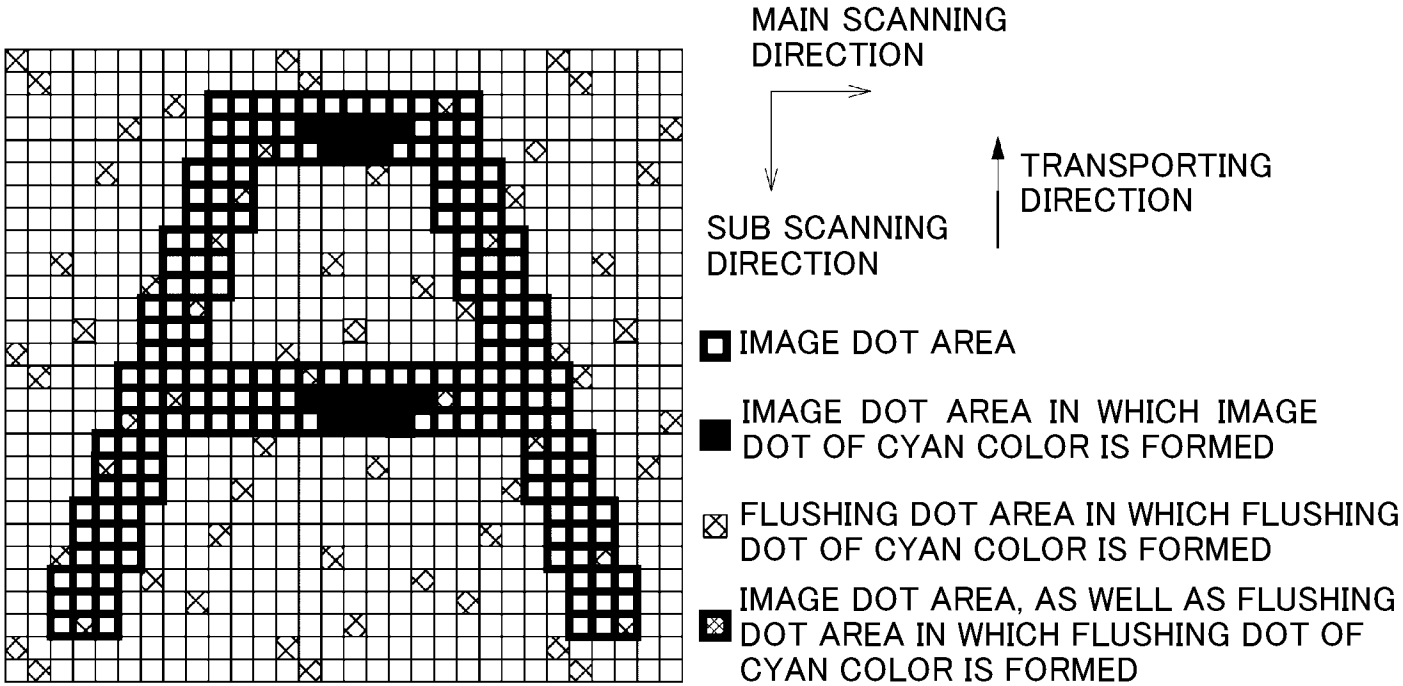

The data writing section 161 makes a judgment of whether to set a predetermined preliminary ejection data stored in the preliminary ejection data storage unit 41 or to set preliminary ejection data which has been created based on the image data stored in the drive data storage unit 40, as the preliminary ejection data related to the preliminary ejection. Concretely, in a case that the image quality mode selected by the mode selecting section 142 is the low image quality mode, the data writing section 161 makes a judgment that the predetermined preliminary ejection data stored in the predetermined ejecting data storage unit 41 is to be set as the preliminary ejection data related to the preliminary ejection. Moreover, the data writing section 161 creates the drive data by writing the predetermined preliminary ejection data stored in the preliminary ejection data storage unit 41 in the image data stored in the drive data storage unit 40. Hereinafter, a case of creating drive data related to the ink of cyan color will be described concretely, while referring to FIG. 6A, FIG. 6B, and FIG. 6C. In FIG. 6A, FIG. 6B, and FIG. 6C, for the sake of expediency, gradation information of the image data has been omitted. Furthermore, image dot areas (areas surrounded by thick lines in the diagram) on which the image dots corresponding to any of the black, yellow, and magenta color inks are formed are also shown in the diagram.

Here, in a case that there exists a ejecting port 108 from which no ink is ejected for not less than a predetermined time during image recording, the preliminary ejection is performed for the ejecting port 108. The preliminary ejection data stored in the preliminary ejection data storage unit 41 is data for performing the preliminary ejection from the ejecting port 108. The predetermined time changes according to the color of the ink, and an ambient temperature and ambient humidity. Moreover, in the embodiment, from view point of data processing, as the preliminary ejection data, a predetermined dot area interval (distance), which is calculated by multiplying the transporting velocity of the paper P by the transporting mechanism 20 by the predetermined time, is used instead of the predetermined time, and the flushing dot areas on which the flushing dots are to be formed is determined for the each predetermined dot area interval. In other words, the flushing dot areas (areas netted in the diagram) are arranged at equal intervals leaving a distance same as the predetermined dot area interval along the transporting direction, in the plurality of dot areas defined on the paper P as shown in FIG. 6A. In a case that the flushing dots are formed in the dot areas which are adjacent to each other, since the visibility of the flushing dots becomes high, the flushing dot areas are set not to be adjacent in the sub-scanning direction.

The data writing section 161, by superimposing the preliminary ejection data (refer to FIG. 6A) corresponding to cyan color, stored in the preliminary ejection data storage unit 41 and the image data (refer to FIG. 6B) corresponding to cyan color, stored in the drive data storage unit 40, creates drive data (refer to FIG. 6C) in which an image dot area in which image dots of cyan color are formed (black colored area in the diagram), and a flushing dot area in which flushing dots of cyan color are formed (netted area in the diagram) exist in the plurality of dot areas on the paper P. In a case that the image dot area in which the image dots of cyan color are formed, and the flushing dot area in which the flushing dots of cyan color are formed exist in the same dot area, the image dot area in which the image dots of cyan color are formed is given priority. In other words, the flushing dots of cyan color are not formed in this dot area.

The data writing section 161 creates the drive data for each color other than cyan color by writing the preliminary ejection data stored in the preliminary ejection data storage unit 41, in the image data stored in the drive data storage unit 40 similarly as for the drive data for cyan color. Accordingly, the ink ejected from the ejecting ports 108 of each head 1 lands on the plurality of dot areas defined on the paper P, based on the drive data (preliminary ejection data) stored in the drive data storage unit 40, and flushing dots corresponding to each ink color are formed. Consequently, it is possible to make an arrangement such that, there exists no ejecting port 108 for which, the non-ejecting time during which the ink is not ejected, is less than the predetermined time.

On the other hand, in a case that the image quality mode selected by the mode selecting section 142 is the high image quality mode, the data writing section, makes a judgment that the preliminary ejection data that has been created based on the image data stored in the drive data storage unit 40 is to be set as the preliminary ejection data related to the preliminary ejection.

Here, in a case that the image quality of the image to be recorded on the paper P is low, when the flushing dots are formed to be superimposed on the image dots, since the probability of degrading the image to be recorded by the image dots is high, forming the flushing dots in the dot area in which the image dots are not formed, enables to suppress the degradation of the image on the paper P due to the flushing dots. However, as the quality of the image recorded on the paper P becomes high, visibility of the flushing dots formed in the image dot area in which the image dots are formed becomes lower than (inferior to) visibility of the flushing dots formed in the dot area in which the image dots are not formed. Therefore, the preliminary ejection data is created such that in the high image quality mode of the present embodiment, a ratio of the number of dot areas in which the flushing dots are formed and also the image dots are formed, to the total number of flushing dot areas on the paper P on which, the flushing dots are formed, becomes higher than the ratio in the case of the low image quality mode. Accordingly, in the high image quality mode, since a large number of flushing dots are formed to be superimposed on the image dots, it is possible to suppress the degradation of image due to the flushing dots. The preliminary ejection data is created by the initial data creating section 162, the computing section 163, and the data changing section 164. A case of creating the preliminary ejection data related to cyan color will be described below in detail by referring to FIG. 7 and FIG. 8. Numerical values in the image dot areas in FIG. 7 indicate brightness of an image recorded in the image dot area. Furthermore, in FIG. 7, for convenience of showing diagrammatically, a scale reduction in the main scanning direction and a scale reduction in the sub-scanning direction are let to be different from a practical scale reduction. Moreover, the flushing dots for the cyan color are let to be dots formed by ink droplets of small size for the cyan color.

The initial data creating section 162, based on the image data related to cyan color stored in the drive data storage unit 40, creates the temporary preliminary ejection data for which, the flushing dot area in which the flushing dots of the cyan color are formed is set tentatively. Concretely, the initial data creating section 162, based on the image data related to the cyan color stored in the drive data storage unit 40, searches the ejecting port 108, for which the non-ejecting time during which the ink is not ejected continuously from the ejecting port 108 reaches the predetermined time, and sets the dot area, on which the ink ejected from this ejecting port 108 is to be landed, as the flushing dot area (netted area in the diagram). At this time, similarly as the preliminary ejection data stored in the preliminary ejection data storage unit 41, the flushing dot areas are set not to be adjacent with respect to the sub-scanning direction. Moreover, the initial data creating section 162 stores the temporary preliminary ejection data created in the temporary data storage unit 42.

The computing section 163 computes the brightness of image in the image dot area in which the image dots corresponding to ink of at least any one color out of the inks of four colors are formed, from the color of ink and the amount of ink ejected from the ejecting ports 108 of each head 1, based on four image data corresponding to the inks of four colors stored in the drive data storage unit 40. Concretely, the computing section 163, as shown in table 1 below, weights yellow (Y) as ⅛, cyan (C) as ¼, magenta (M) as ½, and black (BK) as 1 in order from light color with respect to the color of each ink, and weights the small droplets as ⅛, the medium droplets as ¼, and the large droplets as ½ in order from a smaller amount, with respect to the amount of ink. Next, the computing section 163 multiplies the weights of these colors and the weights of these amounts, and computes for each image dot area, the brightness element of the image dots for each color. For instance, the brightness element in a case of the medium droplets of cyan color is (¼×¼=) 1/16, and the brightness element in a case of medium droplets of black color is (1×⅛=) ⅛. Moreover, a reciprocal of the total brightness element obtained by adding the brightness elements of the image dots for the colors in the respective image dot areas is let to be the brightness of an image in the image dot area. For instance, the brightness of the image dot area in which the image dots related to the medium droplets of cyan color, the small droplets of magenta color, and the small droplets of black color is (1/(1/16+1/16+⅛)=) 4. Since the flushing dots are formed by the ink droplets of small size, the brightness of the flushing dots related to cyan color is (1/(1/32)=) 32.

TABLE 1

| | | Ink color (weight) | | | |
|---|---|---|---|---|---|
| | | Y (1/8) | C (1/4) | M (1/2) | BK (1/1) |
| Ink amount (weight) | Small droplets (1/8) | 1/64 | 1/32 | 1/16 | 1/8 |
| | Medium droplets (1/4) | 1/32 | 1/16 | 1/8 | 1/4 |
| | Large droplets (1/2) | 1/16 | 1/8 | 1/4 | 1/2 |

Figure 7:
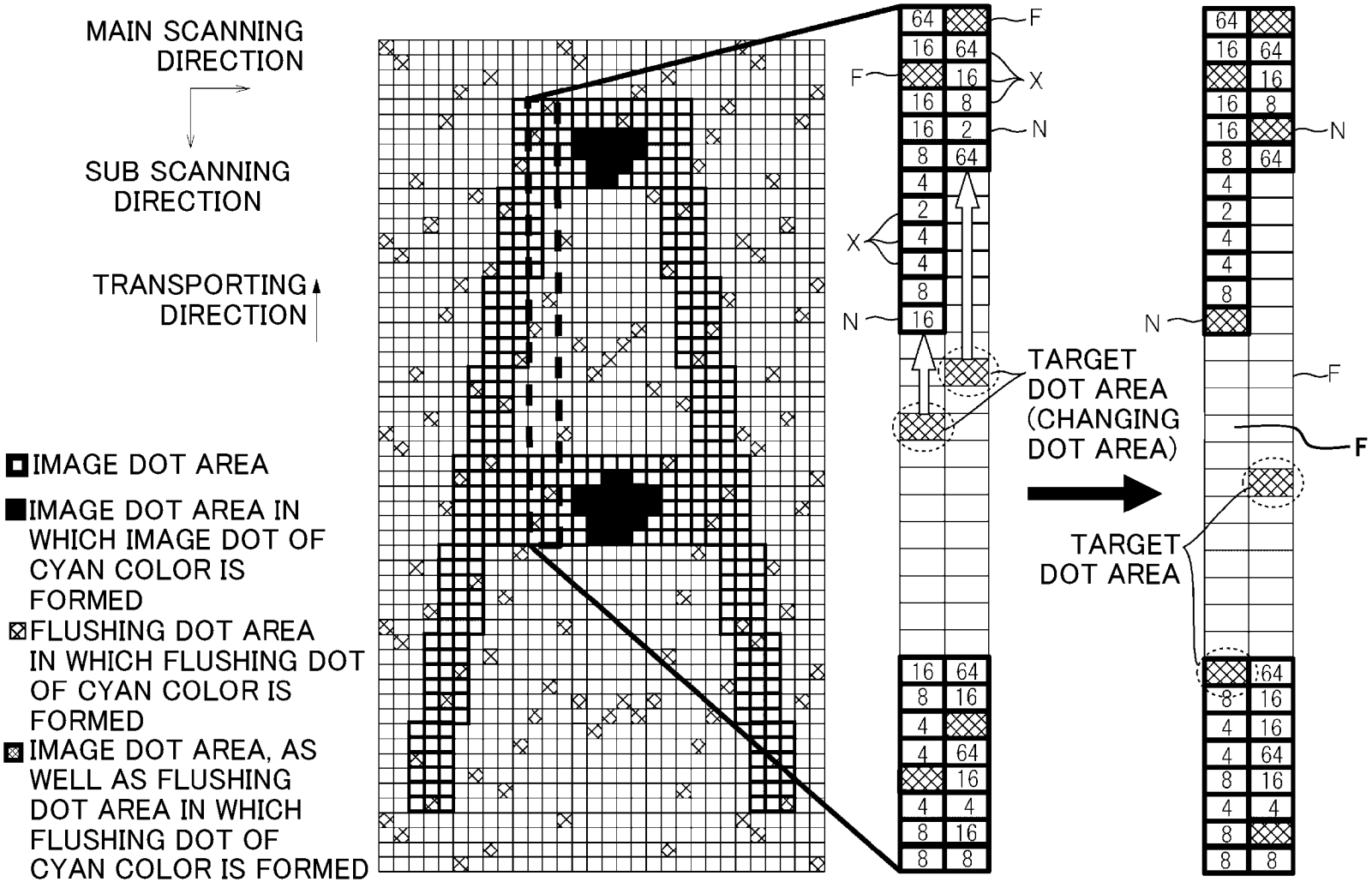
FIG. 7 is a diagram showing a process of determining areas for forming flushing dots in a preliminary ejection data setting section shown in FIG. 5.

The data changing section 164, as shown in FIG. 7, changes a position of the flushing dot area in the temporary preliminary ejection data stored in the temporary data storage unit 42, based on a result of calculation of the brightness of the image in each image dot area of the computing section 163. Concretely, to start with, the data changing section 164 extracts a certain dot area row along the transporting direction, from the temporary preliminary ejection data stored in the temporary data storage unit 42. Next, the data changing section 164 lets a dot area which has been determined as the flushing dot area at the extreme upstream side in the transporting direction, in the dot area row extracted, to be a target dot area, and lets the dot area at the extreme upstream side in the transporting direction to be a first dot area F. Thereafter, the data changing section 164 makes a judgment of whether or not the target dot area is a dot area (hereinafter, "changing dot area") having at least one image dot area X corresponding to one (any) of the black, yellow, and magenta colors between the dot area F and the target dot area, and not an image dot area X corresponding to one of the black, yellow, and magenta colors. In a case that the data changing section 164 has made a judgment that the target dot area is not the changing dot area, the data changing section 164 lets the target dot area to be a new dot area F, and lets a flushing dot area at the extreme upstream side in the transporting direction from among the flushing dot areas on the downstream side in the transporting direction of the target dot area, to be a new target dot area, and repeats the similar processing for all the flushing dot areas which are at the downstream side in the transporting direction.

On the other hand, in a case that the data changing section 164 has made a judgment that the target dot area is the changing dot area, the data changing section 164 moves the changing dot area to any one image dot area N out of the image dot areas X between the target dot area and the dot area F. Here, in a case that there is a plurality of image dot areas X between the dot area F and the target dot area, the data changing section 164 sets on a priority basis the image dot area at the extreme downstream side in the transporting direction as the image dot area N, from among the image dot areas for which, the brightness of images recorded in the plurality of image dot areas X respectively is lower than a predetermined threshold value, and moves the flushing dot area. In the present embodiment, the predetermined threshold value has been set to 32 which is the brightness of the flushing dots for the cyan color. Consequently, as shown in FIG. 7, the image dot area X at the extreme downstream side in the transporting direction from among the image dot areas having brightness of image lower than 32 is set to be the image dot area N on a priority basis, and the flushing dot area is moved.

Next, the data changing section 164 deletes all the flushing dot areas set in the temporary preliminary ejection data, for the dot area at the downstream side in the transporting direction of the target dot area, in one dot area row, and searches the ejecting port 108 newly, for which, the non-ejecting time during which the ink is not ejected continuously from the ejecting port 108 reaches the predetermined time, and sets the dot area on which, the ink ejected from the ejecting port 108 lands, as the new flushing dot area. Even at this time, the flushing dot areas are set not to be adjacent in the sub-scanning direction.

Thereafter, the data changing section 164, in a case that the image dot area in which the image dots of cyan color are to be formed is between the target dot area and the flushing dot area which is at the downstream side in the transporting direction of the target dot area, and at the extreme upstream side in the transporting direction, the image dot area at the extreme downstream side in the transporting direction, from among the image dot areas is let to be the new dot area F. Whereas, in a case that there is no image dot area in which the image dots of cyan color are to be formed, the target dot area is let to be the new dot area. Thereafter, letting the flushing dot area which is at the downstream side in the transporting direction of the dot area F, and at the extreme upstream side in the transporting direction, to be the target dot area, the processing similar to the abovementioned processing is carried out. From here onward, upon changing the target dot area, the similar processing is repeated till the changing dot area ceases to exist, and a position of the flushing dot area of the temporary preliminary ejection data related to the dot area row along the transporting direction is changed. By carrying out the above-mentioned processing, it is possible to lower the visibility of the flushing dots which are formed in a large number in the image dot area with a low brightness of image.

Moreover, as the processing for the one dot area row along the transporting direction is terminated, the data changing section 164 carries out similar processing for all other dot area rows along the transporting direction. Thereafter, as the processing for all the dot area rows along the transporting direction is terminated, the data changing section 164 sets the data stored in the temporary data storage unit 42 as the preliminary ejection data.

Figure 8:
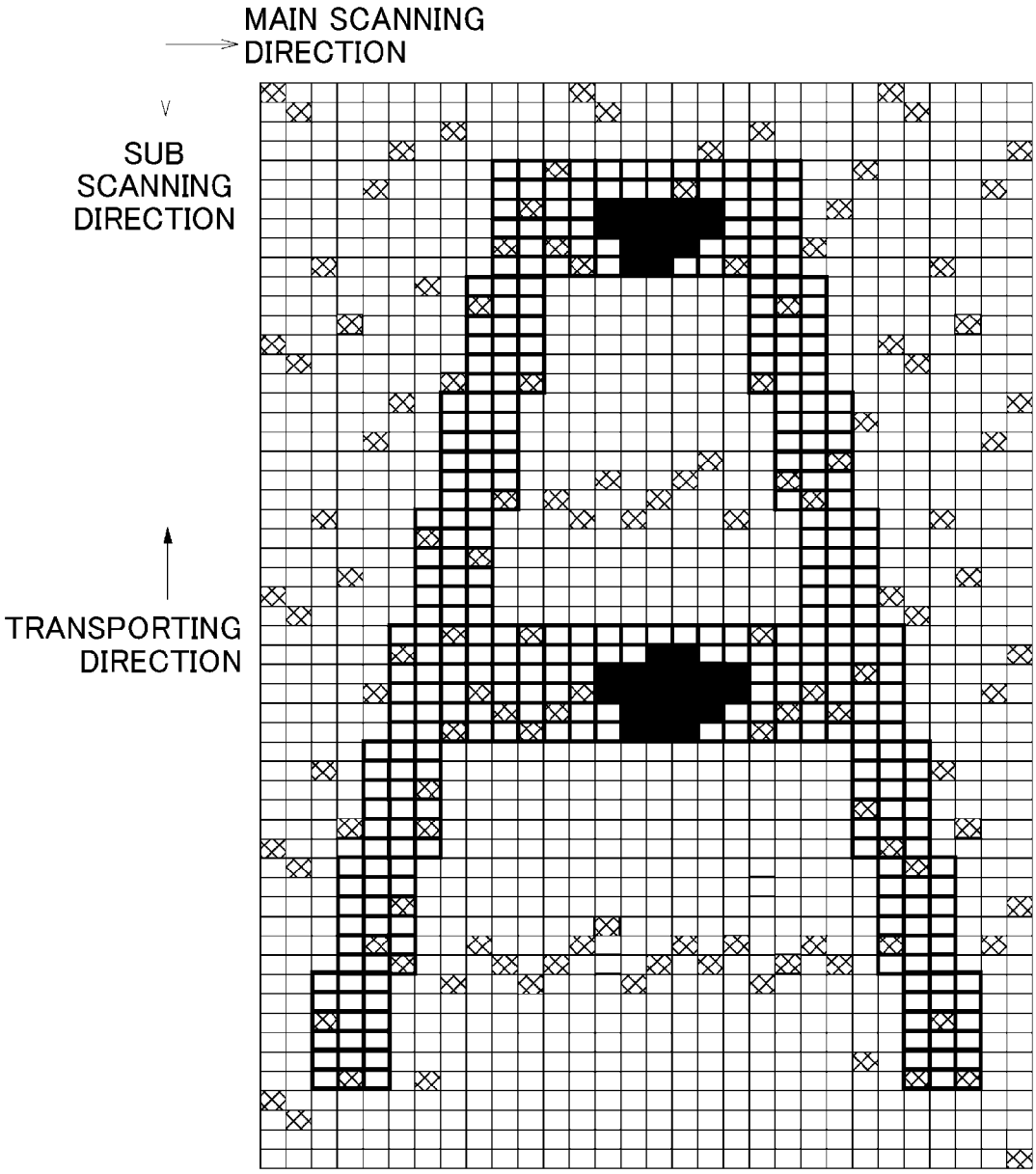
FIG. 8 is a diagram explaining creating of preliminary ejection data in a high image quality mode in the drive data creating section shown in FIG. 5.

Thereafter, the data writing section 161, by writing (superimposing) the preliminary ejection data set by the data changing section 164 on the image data stored in the drive data storage unit 40, the drive data in which the flushing dot area (netted area in the diagram) in which the flushing dots of cyan color are formed, and the image dot area (black colored area in the diagram) in which the image dots of cyan color are formed, in the plurality of dot areas on the paper, as shown in FIG. 8, is stored in the drive data storage unit 40.

Here, regarding the preliminary ejection data for cyan color, in the low image quality mode, as shown in FIG. 6C, the total number of flushing dot areas on the paper P in which the flushing dots of cyan color are formed being 64, and the number of dot areas in which the flushing dots of cyan color are formed, and the image dots of colors other than cyan color are formed being 15, the ratio thereof is ($^{15}/_{64}$=) 0.23. Whereas, in the high image quality mode, as shown in FIG. 8, the total number of flushing dot areas on the paper P in which the flushing dots of cyan color are formed being 125, and the number of dot areas in which the flushing dots of cyan color are formed, and the image dots of colors other than cyan color are formed being 46, the ratio thereof is ($^{46}/_{125}$=) 0.37. In such manner, the ratio in the high image quality mode being higher than the ratio in the low image quality mode, and the large number of dots being formed to be superimposed on the image dots, it is possible to suppress the degradation of image due to flushing dots.

Moreover, the initial data creating section 162, the computing section 163, and the data changing section 164 create the preliminary ejection data in the similar manner for the colors other than cyan color, and create drive data for each color by writing the preliminary ejection data created, on the image data stored in the drive data storage unit 40.

Figure 9:
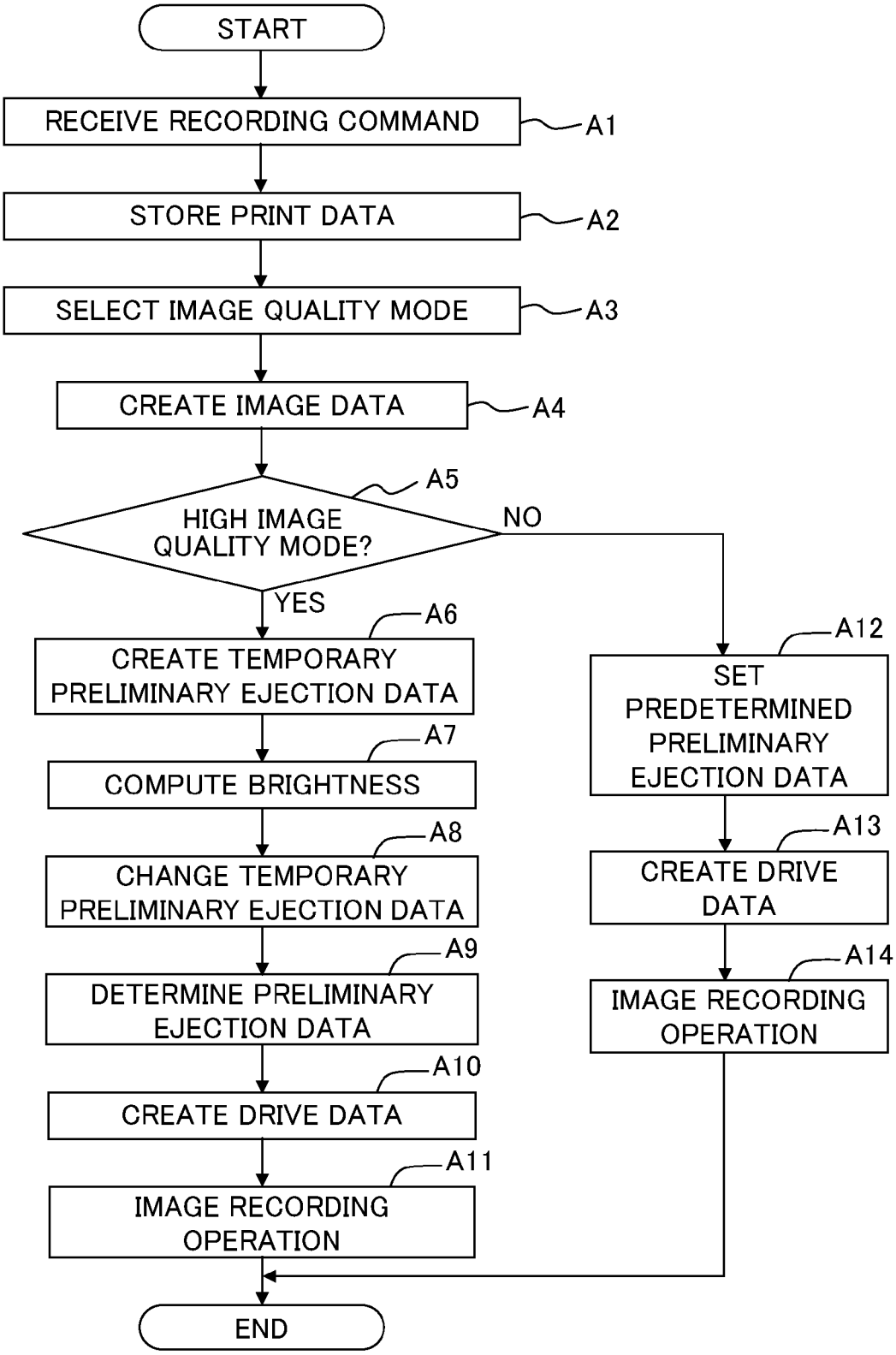
FIG. 9 is a flowchart showing an example of a processing procedure which is carried out in a control unit shown in FIG. 5.

Next, an example of a processing procedure carried out by the control unit 100 at the time of recording an image by the printer 101 will be described below while referring to FIG. 9. Firstly, as the data receiving section 141 receives via the communication interface 36, a recording command transmitted from the external device 50 (step A1), the data receiving section 141 stores print data included in the recording command in the print data storage unit 39 (step A2). Next, the mode selecting section 142, based on the print conditions included in the recording command received by the receiving section 141, selects one of the low image quality mode and the high image quality mode as the image quality mode with respect to an image to be recorded on the paper P (step A3).

Next, the image data creating section 150, based on the print data stored in the print data storage unit 39, creates image data corresponding to each ink color, and stores the image data created in the drive data storage unit 40 (step A4). Thereafter, in a case that the image quality mode selected by the mode selecting section 142 is the high image quality mode (YES at step A5), the data writing section 161 makes a judgment that the preliminary ejection data that has been created based on the image data stored in the drive data storage unit 40 is to be set as the preliminary ejection data to be used in the preliminary ejection. Moreover, the initial data creating section 162, based on the image data stored in the drive data storage unit 40, creates the temporary preliminary ejection data for each ink color, and stores the temporary preliminary ejection data created in the temporary data storage unit 42 (step A6). Next, the computing section 163 computes the brightness of an image in each image dot area on the paper P from the color of ink and the amount of ink ejected from the ejecting ports 108 of each head 1 based on the image data corresponding to the inks of four colors stored in the drive data storage unit 40 (step A7). Thereafter, the data changing section 164, based on a result of computing by the computing section 163, changes a position of the flushing dot area of the temporary preliminary ejection data stored in the temporary data storage unit 42, for each dot area row (step A8), and as the processing for all the dot area rows ends, the data changing section 164 sets the data stored in the temporary data storage unit 42 as the preliminary ejection data (step A9).

Next, the data writing section 161 creates the drive data by writing the preliminary ejection data for each color of ink set by the data changing section 164 in the image data of each color of ink that has been stored in the drive data storage unit 40 (step A10). Thereafter, the transporting control section 144 controls the transporting mechanism 20 via the motor driver 38 such that the paper P is transported with the low transporting velocity, and the head control section 143 controls via the head driving circuit 37, each actuator in the actuator unit 21 provided to each head 1, based on the drive data stored in the drive data storage unit 40 (step A11). Accordingly, an image of high image quality is recorded on the paper P. As the processing at step A11 ends, the present processing operation is terminated.

Whereas, in a case that the image quality mode selected by the mode selecting section 142 at step A5 is the low image quality mode (NO at step A5), the data writing section 161 makes a judgment that the predetermined preliminary ejection data stored in the preliminary ejection data storage unit 41 is to be set as the preliminary ejection data for the preliminary ejection (step A12), and the data writing section 161 creates the drive data by superimposing the predetermined preliminary ejection data stored in the preliminary ejection data storage unit 41 on the image data stored in the drive data storage unit 40 (step A13). Thereafter, the transporting control section 144 controls the transporting mechanism 20 via the motor driver 38 such that the paper P is transported with the high transporting velocity, and the head control section 143 controls via the head driving circuit 37, each actuator in the actuator unit 21 provided to the head 1, based on the drive data stored in the drive data storage unit 40 (step A14). Accordingly, an image of low image quality is recorded on the paper P. As the processing at step A11 ends, the present processing operation is terminated.

As described heretofore, according to the present embodiment, the ratio of the number of dot areas in which the flushing dots are formed as well as the image dots are formed, to the total number of flushing dot areas on the paper P in which the flushing dots are formed is higher for the high image quality mode than for the ratio for the low image quality mode. In other words, in the high image quality mode, since the large number of flushing drops is formed to be overlapped with the image dots, it is possible to suppress the degradation of image due to the flushing dots. Moreover, according to the present embodiment, at the time of moving the flushing dot area from the area in which the image dots are not formed, to the image dot area, since the flushing dot area is moved on priority basis to the image dot area in which the brightness of image is low, it is possible to lower further the visibility of the flushing dots. Moreover, according to the present embodiment, when the image quality mode is the low image quality mode, since the preliminary ejection is carried out based on the predetermined preliminary ejection data stored in the preliminary ejection data storage unit 41, it is not necessary to create the preliminary ejection data as in the high image quality mode. As a result, in the low image quality mode, it is possible to shorten the processing time till the image recording ends.

Modified Examples

Figure 10A:
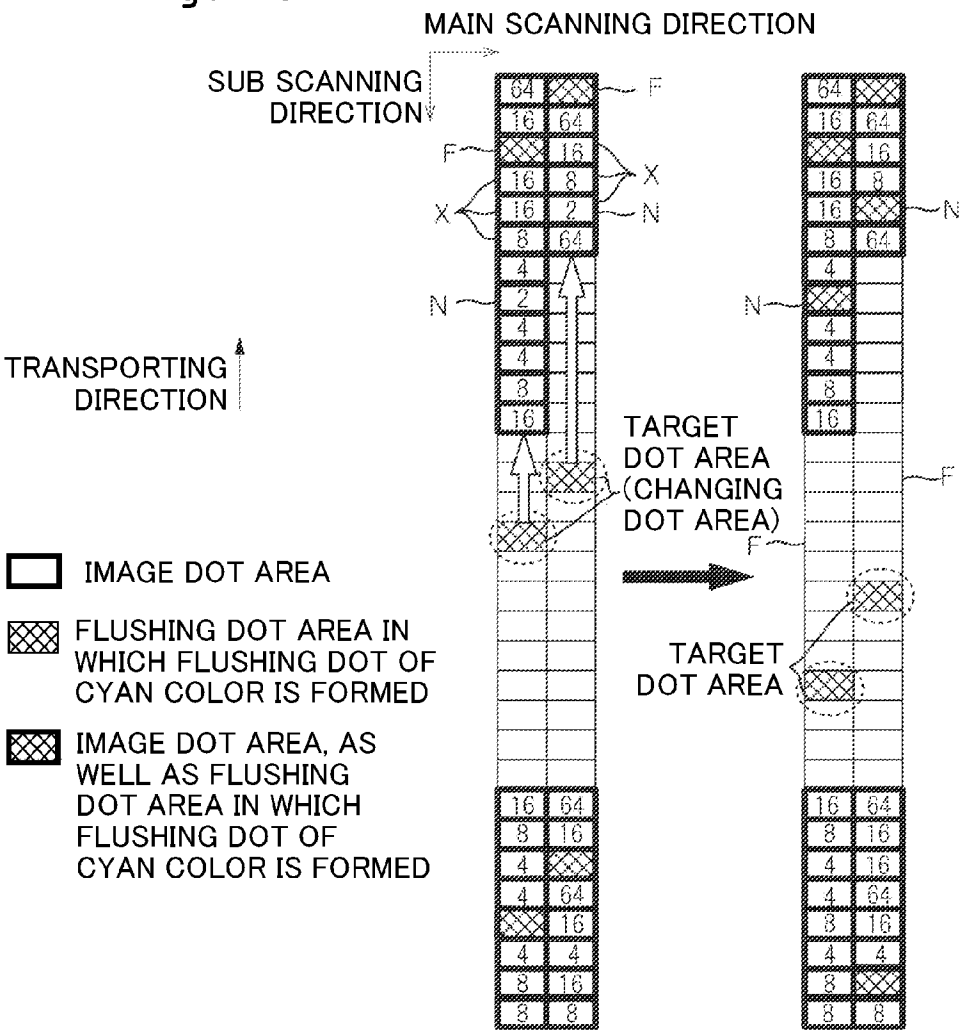
FIG. 10A and FIG. 10B are diagrams showing a modified example of the process of determining areas for forming the flushing dots in the preliminary ejection data setting section shown in FIG. 5.

Next, a first modified example of the present embodiment will be described below while referring to FIG. 10A. FIG. 10A is a diagram showing a process of creating the preliminary ejection data of cyan color, and numerical values in the image dot areas indicate the brightness of the image recorded in the image dot areas. In the first modified example, since a processing method of the data changing section differs, the processing method of the data changing section will be described below.

In the first modified example, the data changing section 164, at the time of changing the flushing dot area of a certain dot area row of the temporary preliminary ejection data stored in the temporary data storage unit 42, makes a judgment that the target dot area is the changing dot area, and in a case that there is a plurality of image dot areas X between the dot area F and the target dot area, the data changing section 164 sets on priority basis, the image dot area X at the extreme downstream side in the transporting direction from among the image dot areas X for which the brightness of an image to be recorded is lower than the brightness of the flushing dot, as the image dot area N, and moves the flushing dot area. In other words, as shown in FIG. 10A, the image dot area which is at the extreme downstream side in the transporting direction from among the image dot areas for which the brightness is lower than 32 which is the brightness of the flushing dots for cyan color, is set as the image dot area N on the priority basis, and the flushing dot area is moved. The rest of the processing is similar to the processing in the abovementioned embodiment. By carrying out the abovementioned processing by the data changing section 164, since the large number of flushing dots is formed in the image dot area in which the brightness of image is lower than the brightness of the flushing dots, it is possible to lower further the visibility of the flushing dots.

Figure 10B:
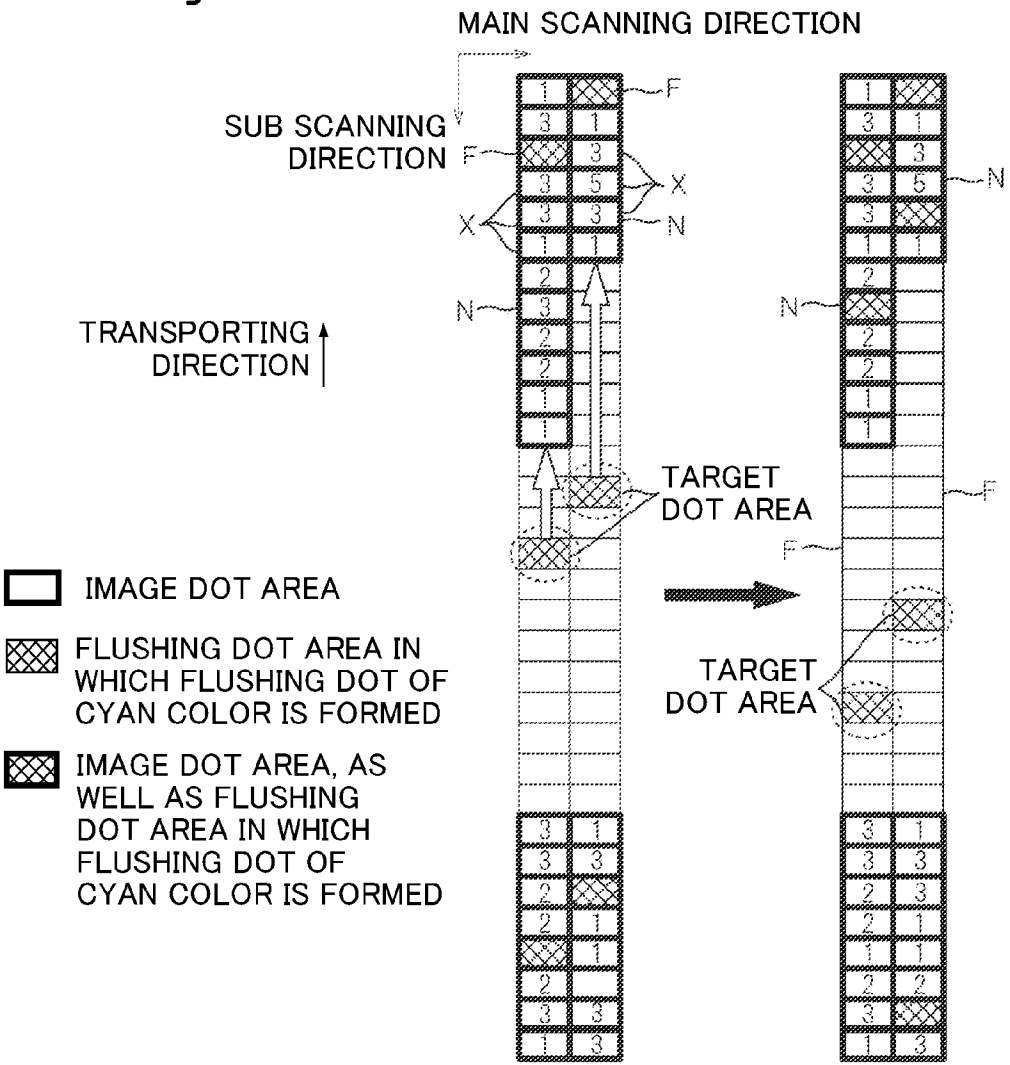

Next, a second modified example of the present embodiment will be described below while referring to FIG. 10B. FIG. 10B is a diagram showing a process of creating the preliminary ejection data for cyan color, and numerical values in the image dot areas indicate a density of an image formed in the image dot area. Moreover, in the second modified example, since a processing method of the computing section and the data changing section differ, the processing method of the computing section and the data changing section will be described below.

The computing section 163 computes the density of the image in the image dot area, in which image dots of at least any one color out of the four colors are formed, from the amount of ink ejected from the ejecting ports 108 of each head 1 based on the four image data corresponding to the inks of four colors stored in the drive data storage unit 40. Concretely, firstly, the computing section 163, with regard to the ink amount, computes for each image dot area, the density of the image dots of each color by assigning 1 to small droplets, 2 to medium droplets, and 3 to large droplets. Next, the computing section 163 lets the total density which is obtained by adding the densities of image dots for all colors in each image dot area, to be the density of the image in the image dot area. For instance, the density of the image formed by medium droplets of cyan color, small droplets of magenta color, and large droplets of black color is (2+1+3=) 6.

Moreover, the data changing section 164, based on a result of computing of the density of the image in each image dot area, changes a position of the flushing dot in the temporary preliminary ejection data stored in the temporary data storage unit 42. Concretely, the data changing section 164, at the time of changing the flushing dot area of a certain dot area row of the temporary preliminary ejection data stored in the temporary data storage unit 42, makes a judgment that the target dot data is the changing dot area, and in a case that there is a plurality of image dot areas X between the dot area F and the target dot area, the data changing section 164 sets on priority basis, the image dot area at the extreme downstream side in the transporting direction from among the image dot areas for which, the density of the image is higher than a predetermined threshold value, as the image dot area N, and moves the flushing dot area. In the second modified example, the threshold value is set to "2". Consequently, as shown in FIG. 10B, the image dot area at the extreme downstream side in the transporting direction from among the image dot areas for which, the density of the image is higher than "2" is set as the image dot area N on the priority basis, and the flushing dot area is moved. The rest of the processing is similar to the processing in the abovementioned embodiment. By carrying out the abovementioned processing by the data changing section 164, since the large number of flushing dots is formed in the image dot area in which the density of image is higher than the threshold value, it is possible to lower the visibility of the flushing dots.

The exemplary embodiment of the present invention has heretofore been described. However, the present invention is not restricted to the abovementioned embodiment, and it is possible to make various design changes within scope of the patent claims. For example, in the abovementioned embodiment, an arrangement has been made to eject ink of one color from one ink-jet head. However, an arrangement may be made such that it is possible to eject inks of plurality of colors from one ink-jet head.

Moreover, in the abovementioned embodiment, in the case that the image quality mode selected by the mode selecting section 142 is the high image quality mode, the preliminary ejection data setting section 160 creates the preliminary ejection data of each color so that the ratio of the number of dot areas, on each of which the flushing dot is formed and also the image dot is formed, to the number of all the flushing dot areas on the paper P, on each of which the flushing dot is formed, becomes higher than the ratio in the case of the low image quality mode. However, the present invention is not restricted to such an arrangement. For instance, the preliminary ejection data setting section 160 may create the preliminary ejection data corresponding to the inks of four colors, so that the ratio of the number of dot areas, on which the flushing dots of the inks of four colors are formed, and the image dots are formed, to the number of all the flushing dot areas on the paper P, on which the flushing dots corresponding to the inks of four colors are formed, becomes higher in the case of the high image quality mode, than the ratio in the case of the low image quality mode. In other words, the preliminary ejection data setting section 160 may create the preliminary ejection data such that the ratio of the total number which is obtained by summing up the dot areas, on which the flushing dots for each color of the ink are formed and the image dots are formed, to the total number which is obtained by summing up the flushing dot areas on the paper P, on which the flushing dots are formed for each color of the ink, becomes higher in the case of the high image quality mode than the ratio in the case of the low image quality mode. In the high image quality mode, even when the ratio of the number of dot areas on which the flushing dots are formed and also the image dots are formed, to the number of all the flushing dot areas on the paper P on which the flushing dots of yellow color are formed is smaller (lower) than the ratio in the case of the low image quality mode, it is preferable that the ratio in which the four colors are summed up is higher than the ratio in the case of the low image quality mode.

Moreover, in the abovementioned embodiment, an arrangement has been made such that, in the case that the image quality mode selected by the mode selecting section 142 is the low image quality mode, the preliminary ejection data setting section 160 sets the predetermined preliminary ejection data stored in the preliminary ejection data storage unit 41 as the preliminary data to be used in the preliminary ejection. However, an arrangement may be made to create the preliminary ejection data based on the image data stored in the drive data storage unit 40, similarly as in the case of the high image quality mode.

Moreover, in the abovementioned embodiment, the high image quality mode has been described as an image quality mode in which the recording resolution with respect to the sub-scanning direction is higher than the recording resolution in the case of the low image quality mode. However, the present invention is not restricted to such arrangement, and the high image quality mode may be an image quality mode in which the amount of ink landing on one dot area on the paper P is larger than the amount of ink landing in the low image quality mode. In this case, for the high image quality mode, it is preferable to make the threshold values of the three types namely, small, medium, and large used when the quantization section 152 creates the image data from the raster data, lower than the threshold values in the case of the low image quality mode. Accordingly, a probability that the large droplets of ink are ejected from the ejecting port 108 becomes high, and since it is possible to make large the amount of ink landing per unit area on the paper P, it is possible to record an image of a high image quality on the paper P.

Moreover, in the abovementioned embodiment, the print data included in the recording command transmitted from the external device 50. However, image data which is image dot data indicating a gradation value corresponding to the amount of ink of each color which is made to land on each dot area may be included in the recording command. In this case, an arrangement may be made such that, the mode selecting section 142 selects any one of the low image quality mode and the high image quality mode, based on the recording resolution of the image data included in the recording command.

Moreover, in the abovementioned embodiment, the printer 101 has two image quality modes namely the low image quality mode and the high image quality mode, as the image quality modes related to the quality of the image recorded on the paper P. However, the printer may have three or more image quality modes. In this case, an arrangement may be made such that, the preliminary ejection data setting section 160 sets the preliminary ejection data such that, higher the quality of image recorded on the paper P in that image quality mode, higher is the ratio of the number of dot areas in which the flushing dots are formed and also the image dots are formed, to the number of all the flushing dot areas on the paper P on which the flushing dots are formed.

Moreover, in the abovementioned embodiment, an arrangement has been made such that, in the case of the high image quality mode, the preliminary ejection data setting section 160 sets the destination of the flushing dot area, based on the brightness of the image in the image dot area. However, an arrangement may be made such that the preliminary ejection data setting section 160 sets the destination of the flushing dot area, not based on the brightness of the image in the image dot area.

Moreover, in the abovementioned embodiment, an arrangement has been made such that, in the high image quality mode, the amount of ink landing per unit area of the paper upon being ejected from the ejecting port 108 of the head 1 becomes larger than the amount of ink landing in the low image quality mode. However, the amount of ink landing per unit area may be same as the amount of ink landing in the low image quality mode. In other words, an arrangement may be such that the amount of ink landing per unit dot area is reduced by an amount equivalent to the number of dots increased in the dot area on the paper P. Even in this case, since the area on which the ink lands increases, it is possible to lower the visibility of the flushing dots by forming the flushing dots to be overlapping with the image dots.

Moreover, in the abovementioned embodiment, the ink-jet printer of line type including the ink-jet head which is longer in the main scanning direction has been described. However, the present invention is also applicable to an ink-jet printer of a serial type, including an ink-jet head which is movable in the main scanning direction.

Moreover, in the abovementioned embodiment, a single CPU may execute each processing, or a plurality of CPUs, or a specific ASIC (application specific integrated circuit), or a combination of a CPU and ASIC may execute the processing.

What is claimed is:

1. A liquid ejecting apparatus comprising:

a plurality of liquid ejecting heads comprising a plurality of ejection nozzles and configured to eject liquids of a plurality of colors respectively from the ejection nozzles;

an image data storage device configured to store image data with respect to an image to be recorded on a recording medium;

a mode receiving device configured to receive one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control device configured to:

control the plurality of liquid ejecting heads, based on the image data, to eject the liquids from the ejection nozzles of the plurality of liquid ejecting heads onto a plurality of image dot areas, among a plurality of dot areas defined on the recording medium, thereby forming image dots of the plurality of colors by the liquids landed on the plurality of image dot areas;

generate a plurality of preliminary ejection data for the plurality of liquid ejecting heads respectively, the plurality of preliminary ejection data being related to preliminary ejections for recovering ejection performances of the plurality of liquid ejecting heads respectively; and control the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received by the mode receiving device, the control device is configured to generate the plurality of preliminary ejection data, so that a ratio of the number of dot areas, on each of which one of the image dots as well as one of the flushing dots is formed, to the number of the flushing dot areas is higher than the ratio in a case that the low image quality mode is received by the mode receiving device.

2. The liquid ejecting apparatus according to claim 1, wherein in the case that the high image quality mode is received by the mode receiving device, the control device is configured to generate the plurality of preliminary ejection data, so that a ratio of the number of dot areas, on each of which one of the image dots as well as one of the flushing dots of one color is formed, to the number of the flushing dot areas on each of which one of the flushing dots of the one color is formed is higher than the ratio in the case that the low image quality mode is received by the mode receiving device.

3. The liquid ejecting apparatus according to claim 1, wherein in the case that the high image quality mode is received by the mode receiving device, the control device is configured to control the liquid ejecting heads so that an amount of a liquid which is landing upon being ejected from the ejection nozzles of the plurality of liquid ejecting heads to land on a unit area of the recording medium is greater than an amount of the liquid landing on the unit area of the recording medium in the case that the low image quality mode is received by the mode receiving device.

4. The liquid ejecting apparatus according to claim 1, further comprising a preliminary ejection data storage device configured to store predetermined preliminary ejection data for each of the liquid ejecting heads, wherein in the case that the low image quality mode is received by the mode receiving device, the control device is configured to set the preliminary ejection data stored in the preliminary ejection data storage device, and in the case that the high image quality mode is received by the mode receiving device, the control device is configured to generate the plurality of preliminary ejection data so that the flushing dots are formed on the image dot areas preferentially, based on the image data stored in the image data storage device, and to set the plurality preliminary ejection data for the plurality of liquid ejecting heads.

5. The liquid ejecting apparatus according to claim 4, further comprising a transporting mechanism which transports the recording medium to an area facing the ejection nozzles of the plurality of liquid ejecting heads, wherein in the case that the high image quality mode is received by the mode receiving device, the control device is configured to control the plurality of liquid ejecting heads and the transporting mechanism, so that a transporting velocity of the recording medium is slower than a transporting velocity of the recording medium in the case that the low image quality mode is received by the mode receiving device, and an ejecting frequency of ejecting the liquids from the ejection nozzles of the plurality of liquid ejecting heads is same as an ejecting frequency in the case that the low image quality mode is received by the mode receiving device.

6. The liquid ejecting apparatus according to claim 1, wherein in the case that the high image quality mode is received by the mode receiving device, the control device is configured to generate the plurality of preliminary ejection data so that the flushing dots are formed preferentially on image dot areas, among the plurality of image dot areas, on which a brightness of the image dots is lower than a predetermined threshold value, based on the image data stored in the image data storage device, and to set the plurality of preliminary ejection data generated for the plurality of liquid ejecting heads.

7. The liquid ejecting apparatus according to claim 1, wherein in the case that the high image quality mode is received by the mode receiving device, the control device is configured to generate the plurality of preliminary ejection data so that the flushing dots are formed preferentially on image dot areas, among the plurality of image dot areas, on which a brightness of the image dots is lower than a brightness of the flushing dots, based on the image data stored in the image data storage device, and to set the plurality of preliminary ejection data generated for the plurality of liquid ejecting heads.

8. The liquid ejecting apparatus according to claim 1, wherein in the case that the high image quality mode is received by the mode receiving device, the control device is configured to generate the plurality of preliminary ejection data so that the flushing dots are formed preferentially on image dot areas, among the plurality of image dot areas, on which a density of the image dots is higher than a predetermined threshold value, based on the image data stored in the image data storage device, and to set the plurality of preliminary ejection data generated for the plurality of liquid ejecting heads.

9. A non-transitory computer-readable storage medium storing computer-executable instructions that, when executed by a processor, cause a liquid ejecting apparatus comprising: a plurality of liquid ejecting heads comprising a plurality of ejection nozzles and configured to eject liquids of a plurality of colors respectively from the ejection nozzles; and an image data storage device configured to store image data with respect to an image to be recorded on a recording medium, to perform:

a mode receiving process of receiving one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control process of:

controlling the plurality of liquid ejecting heads, based on the image data, to eject the liquids from the ejection nozzles of the plurality of liquid ejecting heads onto a plurality of image dot areas, among a plurality of dot areas defined on the recording medium, thereby forming image dots of the plurality of colors by the liquids landed on the plurality of image dot areas;

generating a plurality of preliminary ejection data for the plurality of liquid ejecting heads respectively, the plurality of preliminary ejection data being related to preliminary ejections for recovering ejection performances of the plurality of liquid ejecting heads respectively; and controlling the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received in the mode receiving process, in the control process, the plurality of preliminary ejection data is generated so that a ratio of the number of dot areas, on each of which one of the image dots as well as one of the flushing dots is formed, to the number of the flushing dot areas is higher than the ratio in a case that the low image quality mode is received in the mode receiving process.

10. A control method for controlling a liquid ejecting apparatus comprising: a plurality of liquid ejecting heads comprising a plurality of ejection nozzles and configured to eject liquids of a plurality of colors respectively from the ejection nozzles; and an image data storage device configured to store image data with respect to an image to be recorded on a recording medium, the method comprising:

a mode receiving process of receiving one image quality mode from at least two image quality modes as an image quality mode with respect to an image quality of the image to be recorded on the recording medium, the at least two image quality modes including a low image quality mode and a high image quality mode which has an image quality higher than an image quality of the low image quality mode; and a control process of:

controlling the plurality of liquid ejecting heads, based on the image data, to eject the liquids from the ejection nozzles of the plurality of liquid ejecting heads onto a plurality of image dot areas, among a plurality of dot areas defined on the recording medium, thereby forming image dots of the plurality of colors by the liquid landed on the plurality of image dot areas;

generating a plurality of preliminary ejection data for the plurality of liquid ejecting heads respectively, the plurality of preliminary ejection data being related to preliminary ejections for recovering ejection performances of the plurality of liquid ejecting heads respectively; and controlling the plurality of liquid ejecting heads, based on the plurality of preliminary ejection data generated for the plurality of liquid ejecting heads respectively, to perform the preliminary ejections, thereby forming flushing dots of the plurality of colors on a plurality of flushing dot areas among the plurality of dot areas, wherein in a case that the high image quality mode is received in the mode receiving process, in the control process, the plurality of preliminary ejection data is generated so that a ratio of the number of dot areas, on each of which one of the image dots as well as one of the flushing dots is formed, to the number of the flushing dot areas is higher than the ratio in a case that the low image quality mode is received in the mode receiving process.

* * * * *